US005699647A

United States Patent [19]

Weder et al.

[11] Patent Number: 5,699,647

[45] Date of Patent: *Dec. 23, 1997

[54] COVER FORMING APPARATUS HAVING PIVOTING FORMING MEMBERS

[75] Inventors: Donald E. Weder; Joseph G. Straeter, both of Highland, Ill.; Franklin J. Craig, Valley Park, Mo.

[73] Assignee: Southpac Trust International, Inc.

[ * ] Notice: The term of this patent shall not extend beyond the expiration date of Pat. No. 5,291,721.

[21] Appl. No.: 746,066

[22] Filed: Nov. 6, 1996

Related U.S. Application Data

[63] Continuation of Ser. No. 177,839, Jan. 5, 1994, abandoned, which is a continuation of Ser. No. 927,891, Aug. 10, 1992, Pat. No. 5,291,721.

[51] Int. Cl.[6] ..... B65B 11/00

[52] U.S. Cl. ..... 53/397; 53/461; 53/464

[58] Field of Search ..... 47/72; 206/423; 493/154, 164, 171, 176; 53/173, 175, 218, 219, 220, 221, 390, 393, 397, 399, 456, 461, 464, 563, 580

[56] References Cited

U.S. PATENT DOCUMENTS

| | | | |
|---|---|---|---|
| 137,403 | 4/1873 | Baranowski . | |
| 1,124,618 | 1/1915 | House . | |
| 1,726,929 | 9/1929 | Slocomb et al. . | |
| 1,905,489 | 4/1933 | Nelson | 53/219 |
| 1,942,017 | 1/1934 | Baldwin . | |
| 1,961,640 | 6/1934 | Miller . | |
| 2,018,387 | 10/1935 | Skedden . | |
| 2,027,010 | 1/1936 | Zeigler . | |
| 2,058,070 | 10/1936 | Elkin . | |
| 2,066,449 | 1/1937 | Barrett . | |
| 2,331,543 | 10/1943 | Emery . | |
| 2,367,749 | 1/1945 | Barbieri . | |
| 2,531,386 | 11/1950 | Berman . | |
| 2,642,916 | 6/1953 | Exline, Jr. . | |
| 2,921,424 | 1/1960 | Wertheimer | 53/219 |
| 2,967,652 | 1/1961 | Canfield et al. . | |
| 2,971,312 | 2/1961 | Bell | 53/390 X |
| 3,292,344 | 12/1966 | Fellner | 53/390 X |
| 3,367,589 | 2/1968 | Chant et al. | 53/390 X |
| 3,521,425 | 7/1970 | Palmer | 53/219 X |
| 3,851,439 | 12/1974 | Pillon . | |
| 4,733,521 | 3/1988 | Weder et al. | 53/580 |
| 4,773,182 | 9/1988 | Weder et al. | 47/72 |
| 4,835,834 | 6/1989 | Weder | 47/72 X |
| 4,989,396 | 2/1991 | Weder et al. | 53/397 |
| 5,291,721 | 3/1994 | Weder et al. | 53/390 X |

FOREIGN PATENT DOCUMENTS 9009924 9/1990 WIPO .

*Primary Examiner*—Daniel Moon
*Attorney, Agent, or Firm*—Dunlap & Codding, P.C.

[57] ABSTRACT

A cover forming apparatus for forming a flower pot or flower pot cover from a sheet of material by engaging a sheet of material about the outer surface of a mold, die or pot. The cover forming apparatus includes a plurality of pivotable forming members resting in a surface which supports a sheet of material upon which is positioned a flower pot mold or flower pot. When the forming members are pivotally moved from the storage position to an extended position, the forming members cause the sheet of material to be appressed to or engaged with the mold or pot. The article formed in accordance with the present invention may be separable from the mold or pot and usable as a flower pot or flower pot cover or may be more or less securely attached to the pot by adhesive, cohesive, barbs, friction pinches or other securing means thereby forming a decorative cover connected to a flower pot. The cover forming apparatus may be incorporated within a mobile platform enabling the cover forming apparatus to be moved from one location to another.

18 Claims, 14 Drawing Sheets

COVER FORMING APPARATUS HAVING PIVOTING FORMING MEMBERS

CROSS-REFERENCE TO RELATED APPLICATIONS

This application is a continuation of U.S. Ser. No. 08/177,839, filed Jan. 5, 1994, entitled COVER FORMING APPARATUS HAVING PIVOTING FORMING MEMBERS, now abandoned which is a continuation of U.S. Ser. No. 07/927,891, filed Aug. 10, 1992, entitled COVER FORMING APPARATUS HAVING PIVOTING FORMING MEMBERS, now U.S. Pat. No. 5,291,721, issued Mar. 8, 1994.

FIELD OF THE INVENTION

The present invention generally relates to an apparatus for forming a cover for an object from a sheet of material and, more particularly, but not by way of limitation, to an apparatus having a plurality of pivotable forming members which can be caused to press against the sheet of material for producing flower pots or decorative covers for flower pot objects.

SUMMARY OF THE INVENTION

The present invention comprises a cover forming apparatus for forming a sheet of material about an object to produce a flower pot or flower pot cover for the object. The apparatus comprises a cover former having a plurality of pivotable forming members which are resiliently engageable with portions of the sheet of material and can be made to cooperate to press the sheet of material against the object. When the forming members are moved away from the object, the sheet of material remains in the shape formed thereby as a cover for the object.

DESCRIPTION OF THE PREFERRED EMBODIMENTS

Figure 1:
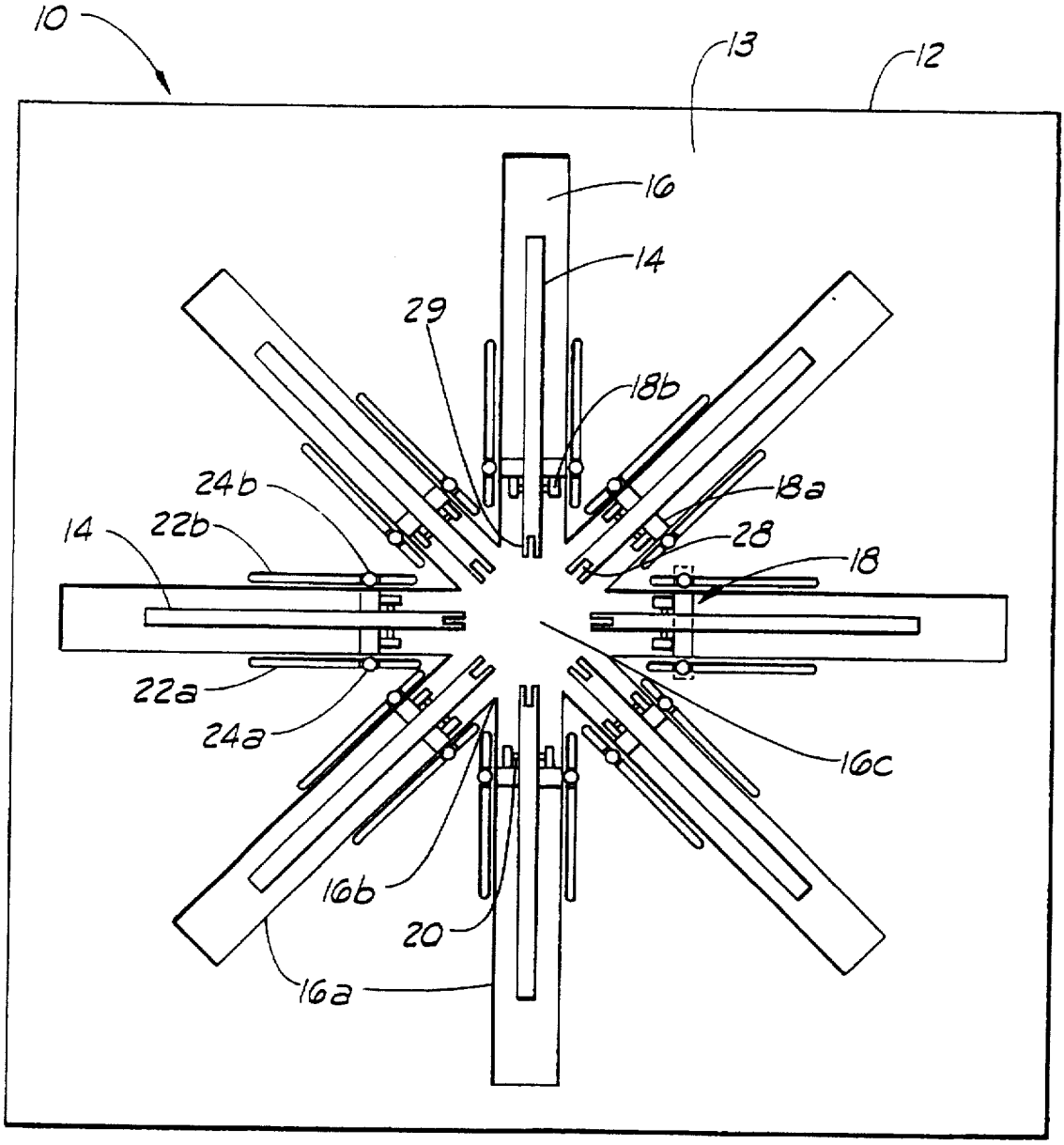
FIG. 1 is a plan view of a cover forming apparatus having eight forming members.
Figure 2:
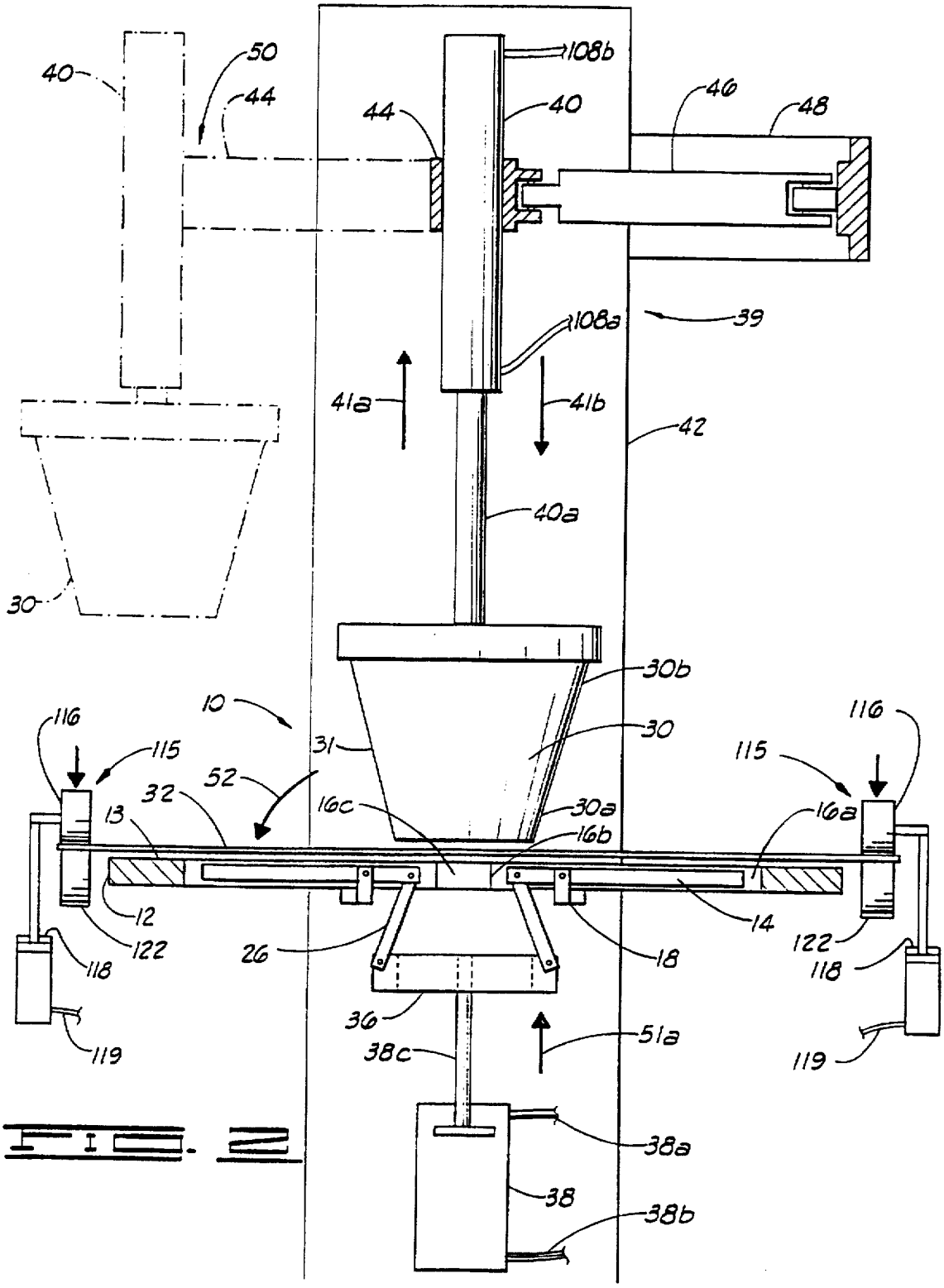
FIG. 2 is a side elevational, partial sectional, diagrammatic view of a cover forming apparatus including a mold support assembly.
Figure 3:
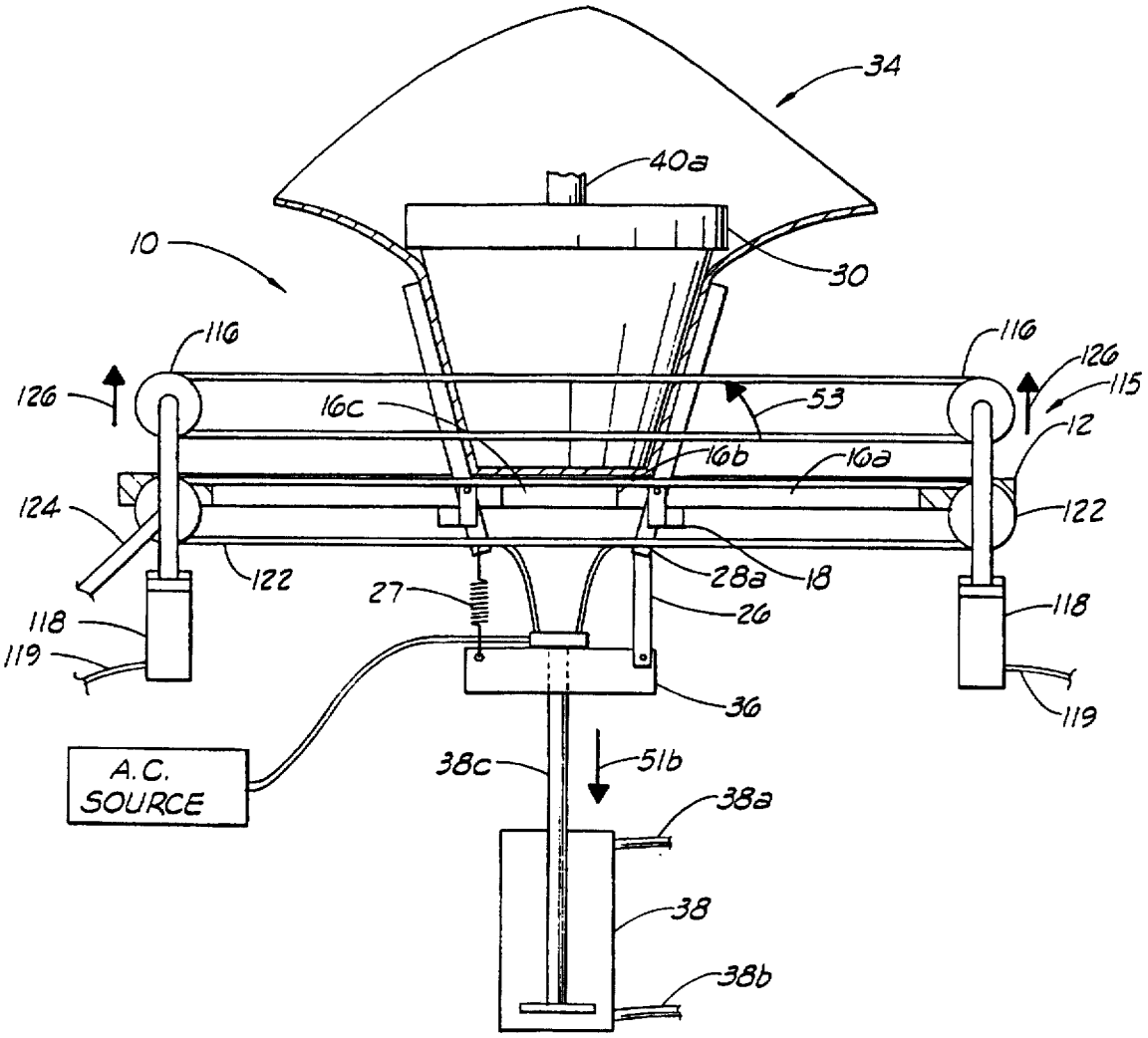
FIG. 3 is a side elevational, partial sectional view of a cover formed by a forming apparatus having forming members in the extended position.

Shown in FIGS. 1, 2 and 3 is a forming apparatus 10 designed to form flower pots or flower pot covers from sheets of flexible material. Such articles have gained wide use in the flower and plant wholesaling and retailing industry. The present invention contemplates a flower pot or flower pot cover forming apparatus which is quite different from any currently used or known pot or cover forming system in that in the present invention the article 34 is formed by pushing the sheet of material 32 peripherally up and around the forming mold or pot 30 with a plurality of discrete pivoting forming members. This method reduces the shear forces which are induced between the inner surface of the female pot or mold and the material and which can act on the material to tear, rip, strip, lacerate, deface or otherwise mar or mutilate the material during the forming process if the material is thin, fragile or decorated in a delicate way. The present invention solves that problem because the pot or die does not shear against the sheet of material but rather acts to receive the sheet of material as the sheet is pressed against the outer surface of the pot or die by the forming members.

Another problem solved by the present invention is that pots which are already filled with plants and potting material, a typical situation in a retail business can be more easily manipulated in the process of being covered. Using the forming apparatus, the pot can simply be placed on a support surface such as the support surface 12 over a sheet of material 32 which is placed on the upper surface 13 of the support surface 12 and the forming members of the forming apparatus 10 pivotally actuated to form the pot cover 34. This reduces the need for manual handling of a soil filled pot or one laden with delicate flowers or foliage which could suffer from the manipulation required to deposit the pot into a cover forming device adapted for manual handling such as a pot wrap stand. Moreover, the positions of the forming members of the various embodiments of the present invention are readily adjustable so that a wide range of pot sizes can be easily and quickly accommodated. In addition, the cover forming apparatus can be made mobile to allow the movement of the apparatus from place to place within a potted plant storage or growing facility.

Figure 4:
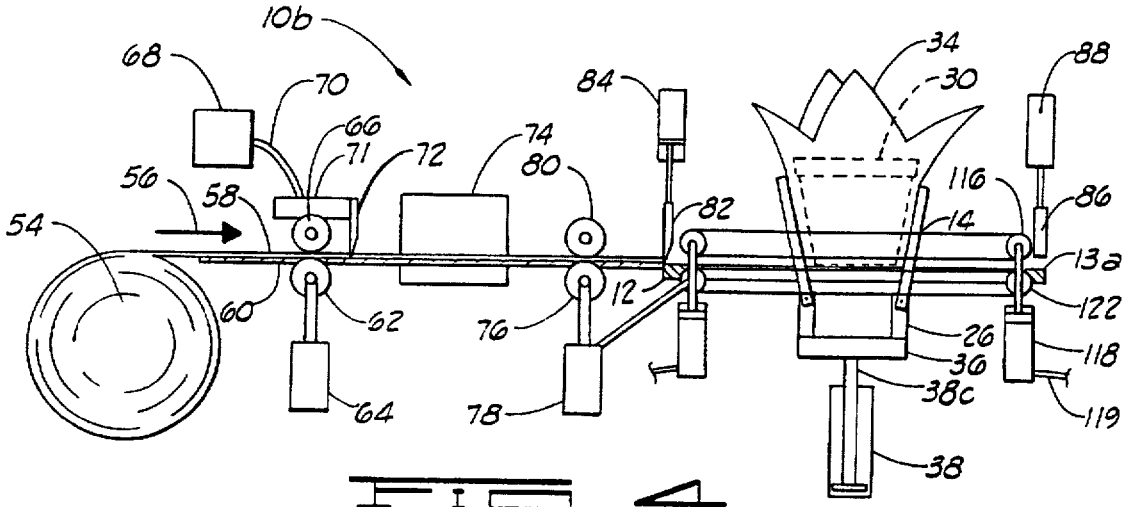
FIG. 4 is a side elevation, sectional view of a forming apparatus where the cover material is supplied by a continuous roll.
Figure 5:
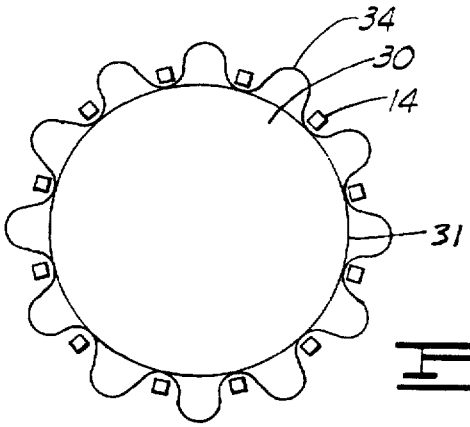
FIG. 5 is a top plan sectional view showing a set of forming members pressing a sheet of material against a mold or pot.

Shown in FIGS. 1, 2, 3 and 4 is a preferred embodiment of a cover forming apparatus 10 which is constructed in accordance with various embodiments of the present invention. The cover forming apparatus 10 is constructed and adapted to form a sheet of material 32 about an object 30 which may be a die, mold or pot to produce a flower pot or flower pot cover 34 (as shown in FIGS. 3 and 4)

As shown in a plan view in FIG. 1, the preferred embodiment of the cover forming apparatus 10 has a support surface 12 which serves as a support means with an upper side 13 upon which is laid a generally square sheet of material 32 The support surface 12 is incised with a plurality of rectangular openings 16 each with an inner edge 16*a*. All openings 16 intersect at the center of the support surface 12 to create a central opening 16*c*. Where two adjacent rectangular openings 16 intersect, the inner edge 16*a* of each rectangular opening meets to form an apical vertex 16*b* at the central opening 16*c*. The apical vertices 16*b* disposed around opening 16*c* provide support for the mold or pot 30 on the support surface 12. Each rectangular opening 16 houses one forming member 14. (In an alternative embodiment, each rectangular opening 16 may house more than one independently acting forming member 14, for example as pairs or triplets of members).

Figure 1A:
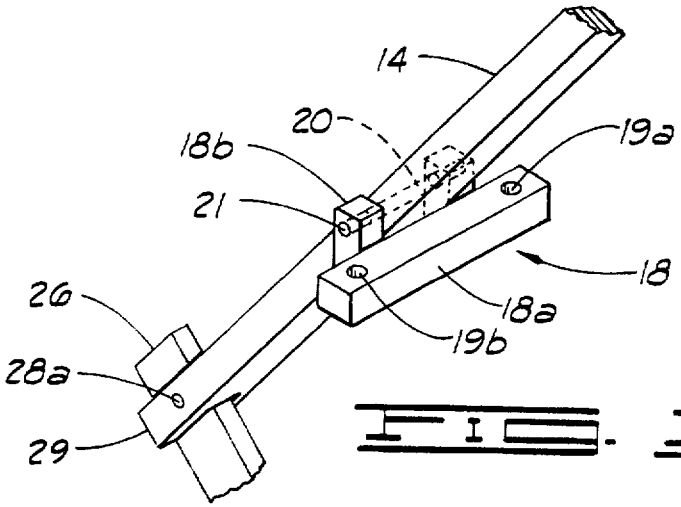
FIG. 1A is an oblique side elevational view of a forming member attached to a pivot mount.

In a preferred embodiment, each pivotable forming member, such as forming member 14, is supported within the apparatus 10 by a pivot assembly 18 as shown generically in FIGS. 1 and 1A which comprises a portion of a pivoting means for pivotally urging the forming members 14. In a preferred embodiment of the pivot assembly 18, the pivot assembly 18 is comprised of a pivot assembly cross arm 18*a* and a pivot assembly forming member 18*b*. The forming member 14 is engaged in a pivoting manner to the forming member mount 18*b* by a pivot assembly forming member mount pin 20 which extends through holes 21 in the forming member mount 18*b* and through the forming member 14. The pivot assembly cross arm 18*a* is slidably engaged to a pair of pivot assembly slots 22*a* and 22*b* which flank and are parallel to each rectangular opening 16. The cross arm 18*a* is engaged to slots 22*a* and 22*b* with pivot assembly cross arm couplers 24*a* and 24*b*, respectively, which extend through holes 19*a* and 19*b*, respectively, in the cross arm 18*a*.

The cross arm couplers 24*a* and 24*b* may be of any variety of pins, screws, clamps, bolts, or other connectors which can be tightened, then loosened and moved, then tightened again to allow the pivot assembly 18 to be repositioned along slots 22*a* and 22*b* so as to realign the forming member 14 within the rectangular opening 16 either closer to or further away from the central opening 16*c* of the support surface 12. This forming member 14 repositioning capability allows the cover forming apparatus 10 to be adapted to die, mold or pot objects having a variety of sizes, diameters and shapes some of which may even be asymmetric or irregularly shaped.

Each forming member 14 has an end 29 proximate to the central opening 16*c* which contains a clevis 28 through which a connecting rod 26 (or connecting spring 27 as shown in FIG. 3) is attached with a clevis pin 28*a* as shown in FIG. 1A. As shown in FIGS. 2, 3 and 4, the connecting rods 26 are attached to a connecting rod head 36 which is mounted on a piston element 38*c* which is reciprocatingly disposed within a hydraulic cylinder 38. The hydraulic cylinder is connected to an air supply (not shown) via air lines 38*a* and 38*b*.

The forming members 14 are shown in the fully retracted or storage position in FIG. 2 wherein the forming members 14 rest fully within the rectangular openings 16 and are more or less parallel to the support surface 12. The retracted or storage position is attained when the cylinder piston 38*c* projects upward in direction 51*a* causing the connecting rods 26 to slant inward and the forming members 14 to move downward in direction 52.

In order for the sheet of material 32 to be brought into a contacting or forming position with the pot or mold 30, as indicated in FIG. 3, the forming members 14 must be projected into an extended position, again as shown in FIG. 3. The extended or forming position of FIG. 3 is attained when the cylinder piston 38*c* projects downward in direction 51*b* causing the connecting rods 26 (or springs 27) to pull downward on the forming members 14 at the point of the clevis connection 28*a*. This force results in the forming members 14 moving in direction 53 toward the mold or pot 30 and pushing the sheet of material 32 up so that it engages the outer surface 31 of the pot or mold 30.

The present invention is contemplated such that the pot or cover 34 formed when the sheet of material 32 is pressed into contact with the mold or pot 30 may either form a readily separable and independent pot or cover 34 or may form a cover 34 which is connected more or less permanently to the pot 30.

The material which comprises the sheet of material 32 is preferably selected from the group of materials consisting of man-made organic polymer films fibers (woven or non-woven, synthetic or natural), foils, paper (treated or untreated), cellulose (including cellophane), leather, burlap, or combinations thereof.

The sheet of material 32 used with the forming apparatus 10 may employ materials having adhesives or cohesives on both sides of the sheet 32, an adhesive on one side and a cohesive on the other side or a cohesive or adhesive on only one side of the sheet 32 with no adhesive or cohesive on the other side of the sheet 32. The sheet 32 may be a heat sealable material for being sealed with heated forming members 14 or other heated devices. The sheet 32 may be a welded film for being welded with heat or welded sonically or with a vibratory welding means.

In one embodiment of the invention the sheet of material 32 is formable into a flower pot or flower pot cover shape 34 which is substantially settable in that it has sufficient strength and rigidity to stand upright on its own. In this embodiment, the pot or cover 34 thus formed is removable from the forming die, mold or pot 30 and generally retains the shape so formed. Furthermore, in this embodiment the plurality of overlapping folds formed during the making of the cover 34 are substantially permanently connected by contacting surfaces which cohere to each other during the forming process.

The sheet of material 32 may require a coating of a cohesive to cause overlapping folds to be sufficiently connected to make the flower pot object 34 substantially settable and shape retaining. In one such embodiment, one side of the sheet of material 32 is coated with a pressure sensitive cohesive material such that when the forming members 14 of the forming apparatus 10 press the sheet of material 32 against the outer surface 31 of the pot or mold 30, the cohesive material causes the contacting surfaces of the overlapping folds to bond or connect to each other resulting in substantially permanent connections among the folds without an adhesive connection between the sheet of material 32 and the pot or mold 30. The formed pot or cover 34 can then be removed from the pot or mold 30.

In another embodiment of a pot or cover 34 removable from the forming die or pot 30, the sheet of material 32 may be coated on one side with a heat sensitive cohesive material such that when the forming members 14 of the forming apparatus 10 (the forming members having been heated to a sufficient temperature) press the sheet of material 32 against the outer surface 31 of the pot or mold 30, the heated forming members 14 activate the cohesive and cause the contacting surfaces of the overlapping folds of the sheet of material 32 to bond or connect to each other resulting in substantially permanent connections among the folds without an adhesive connection between the sheet of material and the pot or mold 30. The formed pot or cover 34 can then be removed from the pot or mold 30.

In another embodiment of a pot or cover 34 removable from the mold or pot 30, the sheet of material 32 itself may comprise a material such as an organic polymer film which is heat sensitive such that when the forming members 14 of the forming apparatus 10 (the forming members 14 having been heated to a sufficient temperature by a heating source) press the sheet of material 32 against the outer surface 31 of the pot or mold 30, the heated forming members 14 cause the contacting surfaces of the overlapping folds of the sheet of material 32 to seal to one another thereby substantially permanently bonding the folds together.

As previously mentioned, it is also contemplated that the present invention will form flower pot covers 34 having contacting surfaces which are more or less permanently connected by adhesives, cohesives or other securing means to outer surface 31 of the pot 30. In one series of embodiments portions of the sheet of material 32 are connected to the pot 30 with various adhesives or cohesives which coat either the sheet 32 or pot 30 or both the sheet 32 and pot 30. In another series of embodiments of the present invention described herein, portions of the sheet of material 32 are connected to the pot 30 with physical elements such as the barbs 92 shown on FIGS. 6 and 7 or a plurality of friction pinches 98 shown on FIG. 8.

In one embodiment of a pot connecting cover 34, at least one side of the sheet of material 32 is coated with a pressure sensitive adhesive of a type adapted to adhesively connect portions of the sheet of material 32 to the pot 30 when such portion of the sheet of material 32 are brought into contact with the pot by the forming members 14 under sufficient pressure to cause the adhesive connection at room temperature. In another embodiment the pressure sensitive adhesive is applied to portions of the outer surface 31 of the flower pot 30 wherein when the sheet of material 32 is brought into contact with the pot 34 by the forming members 14 under sufficient pressure, the portions of the sheet of material 32 which contact the areas of the pot 30 coated with adhesive become adhesively connected to the pot 30.

In an alternate embodiment portions of the outer surface 31 of the forming pot 30 are coated with a pressure sensitive cohesive material. When a sheet of material 32 having at least one cohesively coated surface is oppressed with sufficient pressure by the forming apparatus 10 to the cohesively coated outer surface 31 of the flower pot 30, the cohesively coated portions of the sheet of material 32 are caused to bond with the cohesively coated portions of the flower pot 30.

In a similar embodiment, portions of the outer surface 31 of the forming pot 30 are coated with a heat sensitive cohesive material. A sheet of material 32 having at least one cohesively coated surface is appressed to the outer surface 31 of the flower pot 32 by forming members 14 of the forming apparatus 10 which have been heated to a temperature sufficiently elevated to cause the activation of the heat sensitive cohesive whereby portions of the sheet of material 32 are caused to be connected to the outer surface 31 of the pot 30.

It will be understood by the person of average skill in the art that various kinds of commercially available cohesives and adhesives may be used. A cohesive is defined as a material which tends to bond only to itself, that is, when a cohesive is applied to the surface of an object, will only bond to a surface coated with a similar or identical cohesive material. An adhesive is a material capable of causing binding or sticking to dissimilar surfaces, either uncoated, or similarly coated with the adhesive. The adhesive or cohesive used may be of any of a number of commercially available heat-sensitive or pressure-sensitive cohesives or adhesives including heat sensitive or pressure sensitive lacquers. The adhesive or cohesive material may have been applied to the sheet of material 32 so as to make it ready to use or it may be applied by a roller 66 (see FIG. 4), a brush, sprayer or the like, immediately prior to its use in the cover forming process as shown in FIG. 4.

Figure 6:
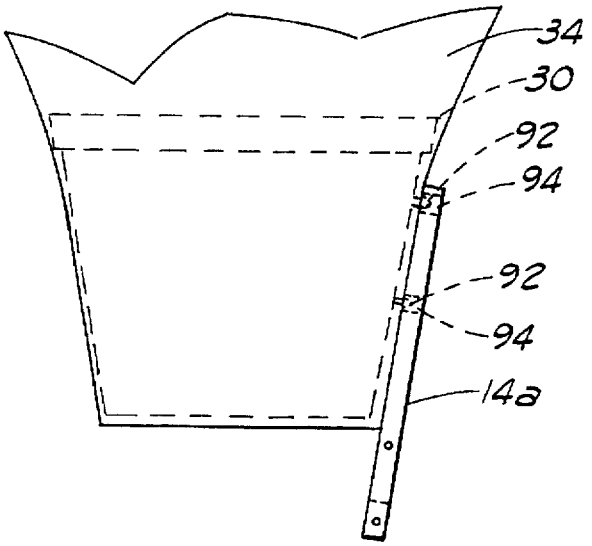
FIG. 6 is a side elevational, sectional view showing a forming member pressing a cover against a barbed pot.

The present invention contemplates methods other than adhesives and cohesives for the attachment of a sheet of material 32 to a pot 30. These methods involve a plurality of securing means which are attached to the outer surface 31 of the flower pot 30. For example, in one embodiment, the securing means may be pointed barbs 92 which are attached to the outer surface 31 of the flower pot 30 and which extend pointing away from the surface of the flower pot 30. When the sheet of material 32 is appressed against the outer surface 31 of the flower pot 30, the sheet engages the barbs 92, which causes the barbs 92 to puncture the sheet of material 32 causing the material 32 to be caught underneath the head of the barb 92 thereby fastening the sheet of material 32 to the flower pot 30 as shown in FIGS. 6 and 7.

The barbs 92 may be distributed randomly across the outer surface of the pot 30 or may be organized in a non-random pattern of rows, columns or diagonals, or the like. The forming members 14 of the forming apparatus 10 may be modified as shown in FIGS. 6 and 7 so as to more efficiently engage the barbs 92 on the outer surface 31 of the pot 30. In one example, the forming member 14*a* shown in FIG. 6 comprises at least one aperture 94 positioned so that the barb 92 is projected into the aperture 94 when the forming member 14*a* is appressed against the outer surface 31 of the barb-bearing pot 30.

The aperture 94 may have the shape of a square, rectangle, or cylinder, or other appropriate shape and may protrude completely or only partially through the forming member 14*a*. As the barb 92 projects into the aperture 94 of the forming member 14*a*, the barb 92 punctures the sheet of material 32 causing a portion 32*a* of the material to be caught underneath the barb 92. When the forming member 14*a* is retracted away from the pot 30, the sheet of material 32 remains connected to the pot 30, having formed a cover 34 of the pot 30.

Figure 7:
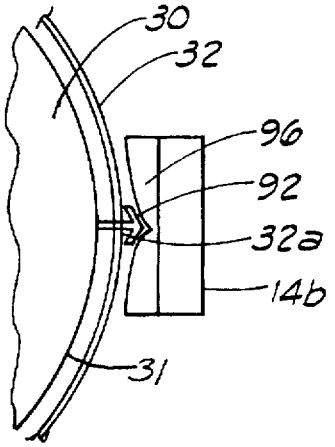
FIG. 7 is a top plan sectional view showing a forming member pressing a sheet of material against a barb.

In another example, the forming member 14*b* shown in FIG. 7 comprises an inner surface of a substantially flexible material 96 such as a springy but firm foam or rubber. This flexible material 96, when caused to press a portion of a sheet of material 32 against a barb or barbs 92, is sufficiently flexible that it pushes the material about the barb 92 thereby causing the barb 92 to puncture the sheet of material 32 so that a portion of the material 32a is caught below the head of the barb 92 thereby fastening the material 32 to the pot 30 forming a cover 34 around the pot 30. This type of forming member 14b with a flexible inner surface 96 is especially adapted to engaging barbs 92 which are randomly or otherwise positioned on the surface of the pot 30 in such a way that the barbs 92 would be misaligned with the apertures 94 of an aperture-bearing forming member 14a.

Figure 8:
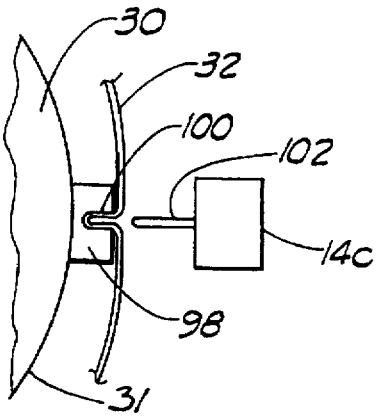
FIG. 8 is a top plan sectional view showing a friction pinch element and friction pinch forming member.

In another embodiment of the securing means which are attached to the outer surface 31 of the pot 30, the securing means may be a plurality of female friction pinch elements 98 as shown on FIG. 8. The female friction pinch elements 98 are distributed over the outer surface 31 of the pot 30 in some non-random fashion which allows at least one female friction pinch element 98 to be mated with at least one male friction pinch element 102 carried on a forming member 14c modified to be able to mesh with female friction pinch elements 98.

As shown on FIG. 8, when a male friction pinch element 102 presses a sheet of material 32 against a female friction pinch element 98 and causes a portion 100 of the sheet of material 32 to be inserted into the female friction pinch element 98, the inserted material 100 acts to fasten the sheet of material 32 to the outer surface 31 of the flower pot 30. As indicated, the forming member 14c with at least one male friction pinch element 102 comprises another specialized embodiment of forming member 14.

Figure 9:
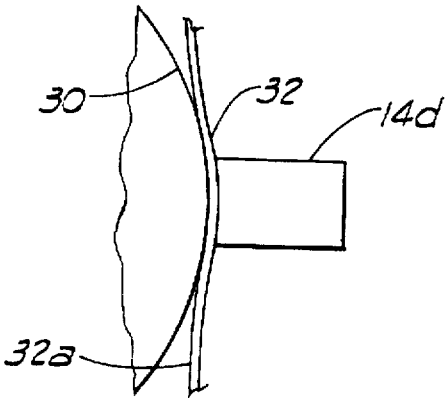
FIG. 9 is a top plan sectional view showing a heat-sealing forming member pressing a heat-sensitive sheet against a pot cover.

Another forming member modification is the forming member 14d as shown in FIG. 9 which represents a forming member 14d capable of being heated to a temperature sufficiently elevated to cause the heat activation of sheets of material 32 coated with heat-sensitive adhesives or cohesives or sheets of material 32 composed of organic polymer films which are themselves heat sealable and bondable.

As noted previously, the present invention contemplates embodiments in which the sheet of material 32 can either be permanently affixed to the flower pot 30 as indicated by FIGS. 5, 6, 7, 8 and 9 or can be formed in such a way as to leave them free from the mold 30 around which they were formed. In one embodiment shown in FIG. 2, a manufacturing process is envisioned in which the cover forming apparatus 10 would include a positioning assembly 39 for positioning the mold 30 on the forming surface 13 and for retracting the mold 30 into a storage position above and away from the forming apparatus surface 12 indicated at 50.

In the positioning assembly 39, as shown in FIG. 2, a die or mold 30 is connected to a piston or rod 40a which is reciprocatingly disposed in a hydraulic cylinder 40. The die or mold 30 may be generally frusto-conically shaped with the narrower end 30a positioned distally to the cylinder 40 and the wider end 30b positioned proximally to the cylinder 40. The hydraulic cylinder 40 is adapted and positioned to move the die or mold 30 in a downward position 41b to a forming position and to move the die or mold 30 in an upward position 41a to a storage position. The hydraulic cylinder 40 is connected to a support assembly 42 by a pivoting beam 44.

The support assembly 42, the beam 44, and the hydraulic cylinder 40 together support the die or mold 30 a distance above the support surface 12. An air supply (not shown) is supplied via air lines 108a and 108b to the hydraulic cylinder 40 to control the movement of the mold 30 in an upward direction 41a and a downward direction 41b. In the forming process the die or mold 30 is disposed in a downward direction 41b until it comes to rest on the sheet of material 32 which is disposed between the upper side 13 of the support surface 12 and the die or mold 30.

After the pot or cover 34 has been formed around the die or mold 30 in the forming member extending process described previously, the die or mold 30 is retracted by cylinder rod 40a in an upward position 41a whereby the newly formed pot or cover 34 is removed from the die or mold 30. The forming apparatus 10 is returned to the retracted or storage position in the manner described previously. Another sheet of material 32 is placed on the upper side 13 of the support surface 12 in preparation for another pot or cover forming production cycle.

The die or mold 30 and the cylinder 40 can also be displaced from its storage position directly over the support surface 12 to an offset position as shown at 50 in FIG. 2. A secondary hydraulic cylinder 46 is attached by a reciprocatingly disposed rod to beam 44 which is pivotally attached to the cylinder 40. The secondary hydraulic cylinder 46 is attached to the support assembly 42 by a support armature 48. The hydraulic cylinder is connected to an air supply (not shown) which is connected to a control valve (not shown) which controls the operation of the hydraulic cylinder 46.

In the position shown in FIG. 2, cylinder 46 is retracted, causing the primary cylinder 40 to be positioned directly above the forming apparatus 10. The cylinder rod in cylinder 46 can be extended to cause the beam 44 to be pivotally moved to the position 50 whereby beam 44 carries cylinder 40 and mold 30 in a direction which causes the cylinder 40 and mold 30 to be in a position offset from the support surface 12. The positioning assembly 39 may also include a cover unloading assembly (not shown) adapted to remove the formed covers from the mold 30.

It will be appreciated that in an alternative embodiment, the cover forming apparatus 10 can operate manually without benefit of the positioning assembly 39 wherein a pot 30 is placed manually and the forming members 14 are caused to form a cover 34 about the pot 30.

It is envisioned that when the present invention is designed in an alternative embodiment as part of a manufacturing process, it is possible that to increase the efficiency of the process the sheet of material 32 may be provided from a roll of material 54 as shown in FIG. 4 wherein the roll of material 54 is adapted to roll in a direction 56 and thereby feed the material as a sheet 58 over an extension 60 of the support surface 12 into a system of rollers 62 and 66 as part of the operation of system 10b in FIG. 4. The roll of film 54 is supported generally near surface 60. The material 58 on the roll 54 is passed through a pair of rollers 62 and 66 where at least one of the rollers, shown as 62 in FIG. 4, is drivingly connected to a motor 64 or other such drive means which is adapted to drivingly rotate the roller 62 connected thereto for drivingly moving the sheet of material 58 between the rollers 62 and 66 thereby unrolling a portion of the material from the roll of material 54 and passing a portion of the sheet of material 58 in the direction 56 generally onto a portion of the upper side of the surface 60 in preparation for its final positioning on surface 12 above the forming apparatus of 10b.

The system 10b is shown to include a cutting assembly 84 and 82 which includes a knife 82 having a portion thereof connected to a rod reciprocatingly disposed within a hydraulic cylinder 84 which is connected to an air supply and control mechanism (not shown) and is supported at a position above the support surface 12. The material 58 being unrolled from roll 54 and drivingly fed through rollers 62 and 66 is further directed over surface 60 and fed into rollers 76 and 80, one roller of which, and more particularly in this case roller 76, is drivingly connected to a driving means 78 which is adapted to drivingly rotate roller 76 and drivingly move sheet 58 in direction 56 toward the support surface 12.

The forming apparatus 10*b* may also be equipped with a conveyor belt assembly 115 (see FIGS. 2, 3 and 4) which receives the sheet of material 58 for advancing the sheet of material 58 onto the support surface 12. The conveyor belt assembly comprises an upper conveyor belt 116 and a lower conveyor belt 122. The upper conveyor belt 116 is connected to a displacing means 118 which, in the preferred embodiment, lifts the upper conveyor belt 116 in a direction 126 whereby the sheet of material 58 is then released. The lower conveyor belt 122 is connected to a drive means 124. When the upper conveyor belt 116 is in a lowered operating, position (see FIG. 2) the drive means 124 drives both the lower conveyor belt 122 and the upper conveyor belt 116 for driving the sheet of material 58 disposed therebetween. The displacing means 118 may be a hydraulic or air cylinder which is activated by a fluid or air supply 119, respectively.

The system 10*b* is equipped with a sensing device 86 which is adapted to sense the positioning of the sheet of material 58 on the support surface 12. The conveyor assembly 115 drivingly moves the material 58 onto the support surface 12 until sensing device 86 senses the presence of the material 58 at the edge 13*a* of the support surface 12. The sensing device 86 activates a sensor relay means 88 which causes rollers 62 and 76 and conveyor assembly 115 to be stopped, which in turn stops further movement of the sheet of material 58 on the surfaces 58 or 12 of apparatus 10*b*. The relay means 88 also directs the cutting assembly cylinder 84 to extend the blade 82 such that a portion of the roll of material 58 is severed thereby leaving a generally square-shaped sheet of material 32 operatively disposed onto the support surface 12 above the forming apparatus of 10*b* in preparation for the next production cycle. After the sheet of material 32 has been cut from the roll of material 54, the hydraulic cylinder 84 returns the blade 82 to the storage position.

The material on the roll of material 54 may be previously coated with a cohesive or adhesive material or, in the embodiment shown in FIG. 4, the adhesive or cohesive may be applied just prior to being moved into position on surface 12 over the forming apparatus of 10*b*. In such an embodiment, the adhesive or cohesive material is stored in a reservoir 68 and fed via a line 70 into an applicator assembly 71 which includes an applicator roller 66 and a doctor blade 72. Adhesive or cohesive is applied to the sheet of material 58 as it rolls underneath the roller 66. The doctor blade 72 is located down line from the roller 66 and is positioned at some height above the sheet of material 58 where it serves to remove excess amounts of adhesive or cohesive by scraping the excess away as the sheet of material 58 is driven in direction 56 toward the forming apparatus of system 10*b*. A drying oven 74 is located down-line from the applicator assembly 71 and serves to dry the adhesive or cohesive prior to its movement through rollers 76 and 80.

Figure 10A:
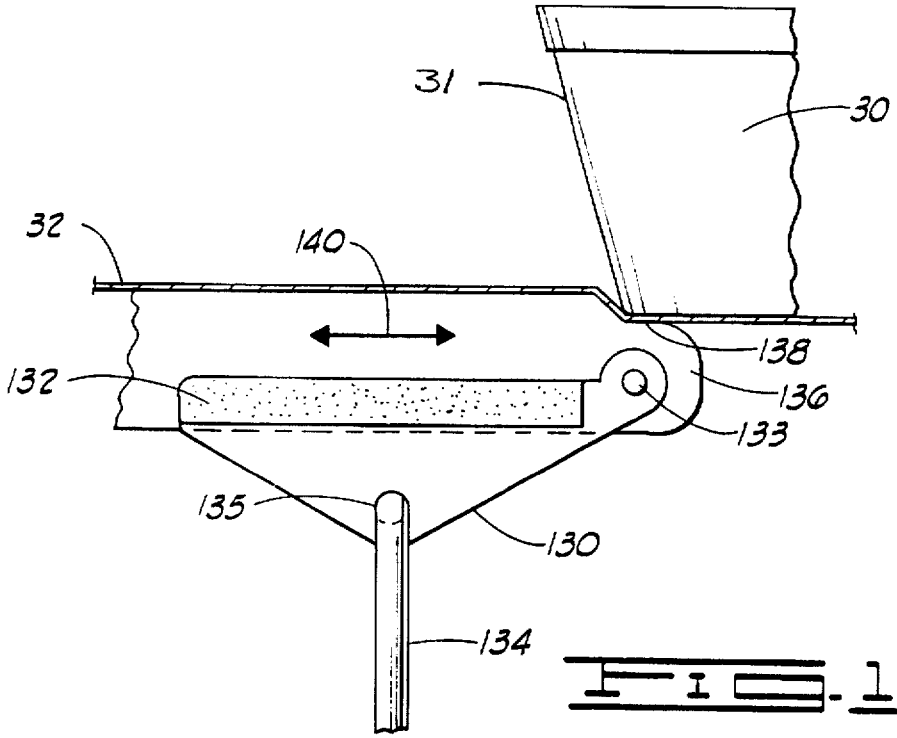
FIG. 10A is a side view of an alternative forming member embodiment showing the forming member in a storage position.

Other embodiments of the pivoting forming members and of the pivot assemblies which comprise the pivoting means can be envisioned as illustrated in FIGS. 10A through 14B. The FIGS. 10A–14B show only one or two forming members but it will be understood that each embodiment is comprised of a plurality of forming members. In FIG. 10A a pot 30 is shown disposed over a sheet of material 32. The forming member 130 has a forming surface 132 which may be comprised for example, of a foam material. The pot 30 rests upon the recessed portion 138 of a support surface 136. The forming member 130 is pivotally attached at pivot position 133 to the support surface 136. The forming member 130 is attached to a connecting rod 134 which is connected to a connecting rod head (not shown). The rod 134 is pivotally attached at pivot point 135 of forming member 130. As indicated in FIG. 10B, when the rod 134 is moved in a direction 137, the forming member 130 is forced in a direction 138 wherein the sheet 32 is pressed against the outer surface 31 of the pot 30 by the forming surface 132. The support surface 136 can be moved in direction 140 to be adjusted for differing sizes of the pot 30.

Figure 11A:
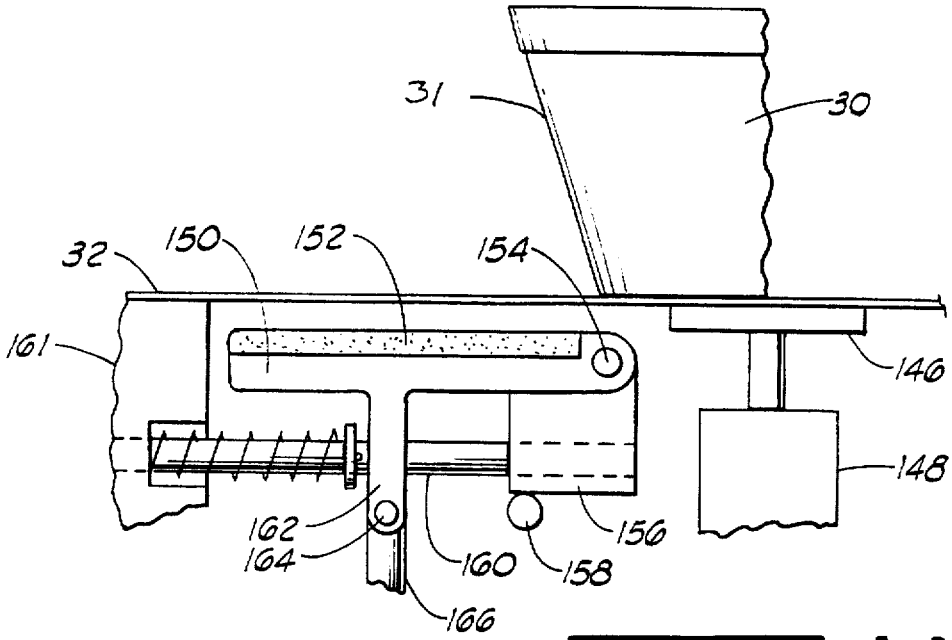
FIG. 11A is a side view of an alternative embodiment showing a forming member in a storage position.
Figure 11B:
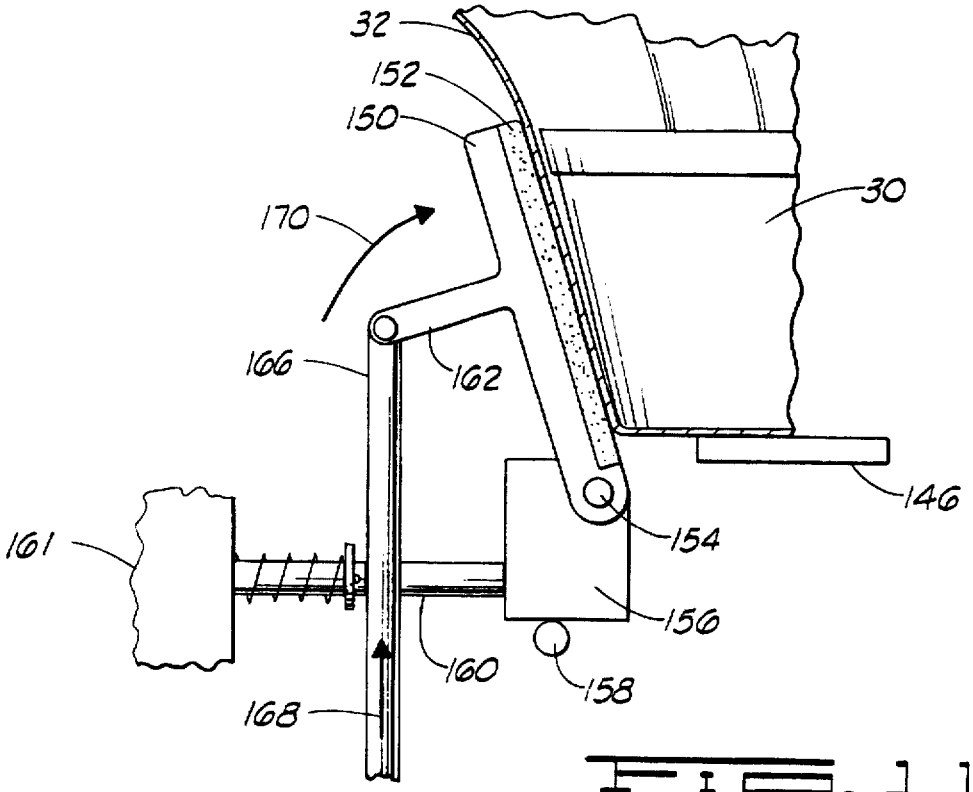
FIG. 11B is a side view of the alternative embodiment of FIG. 11A with the forming member in an extended position.

Another embodiment is illustrated in FIGS. 11A and 11B. The forming member 150 has a forming surface 152. The forming member 150 is attached at a pivot point 154 to a pivoting head 156. The pivoting head 156 is connected to a positioning rod 160. The positioning rod 160 is reciprocatingly attached to a support surface 161. Pivoting head 156 rests upon and is rollingly engaged with a roller 158. Forming member 150 has an extension arm 162 which is connected at a pivoting point 164 to a connecting rod 166. The pot 30 is supported by a supporting surface 146 which is reciprocatingly attached to a supporting cylinder 148. When the connecting rod 166, attached to a connecting rod head (not shown) is pushed upward in a direction 168 (see FIG. 11B) the forming member 150 is moved into a direction 170 wherein the sheet of material 32 is pressed by the forming surface 152 against the outer surface 31 of the pot 30. The position of the forming member 150 and the pivoting head 156 can be modified by changing the position of the positioning rod 160 in relation to the support surface 161 as indicated in FIG. 11B.

Figure 12A:
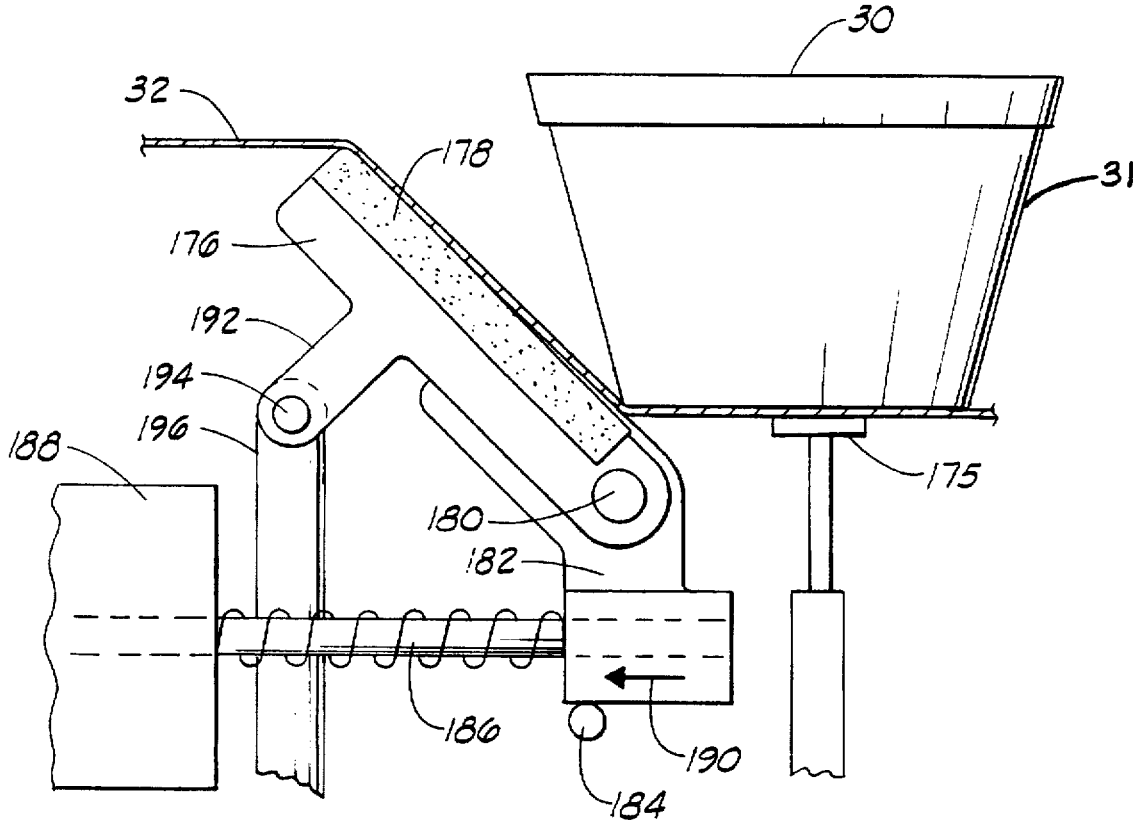
FIG. 12A is a side view of an alternative embodiment of a forming member assembly showing a forming member in a partial extended position.
Figure 12B:
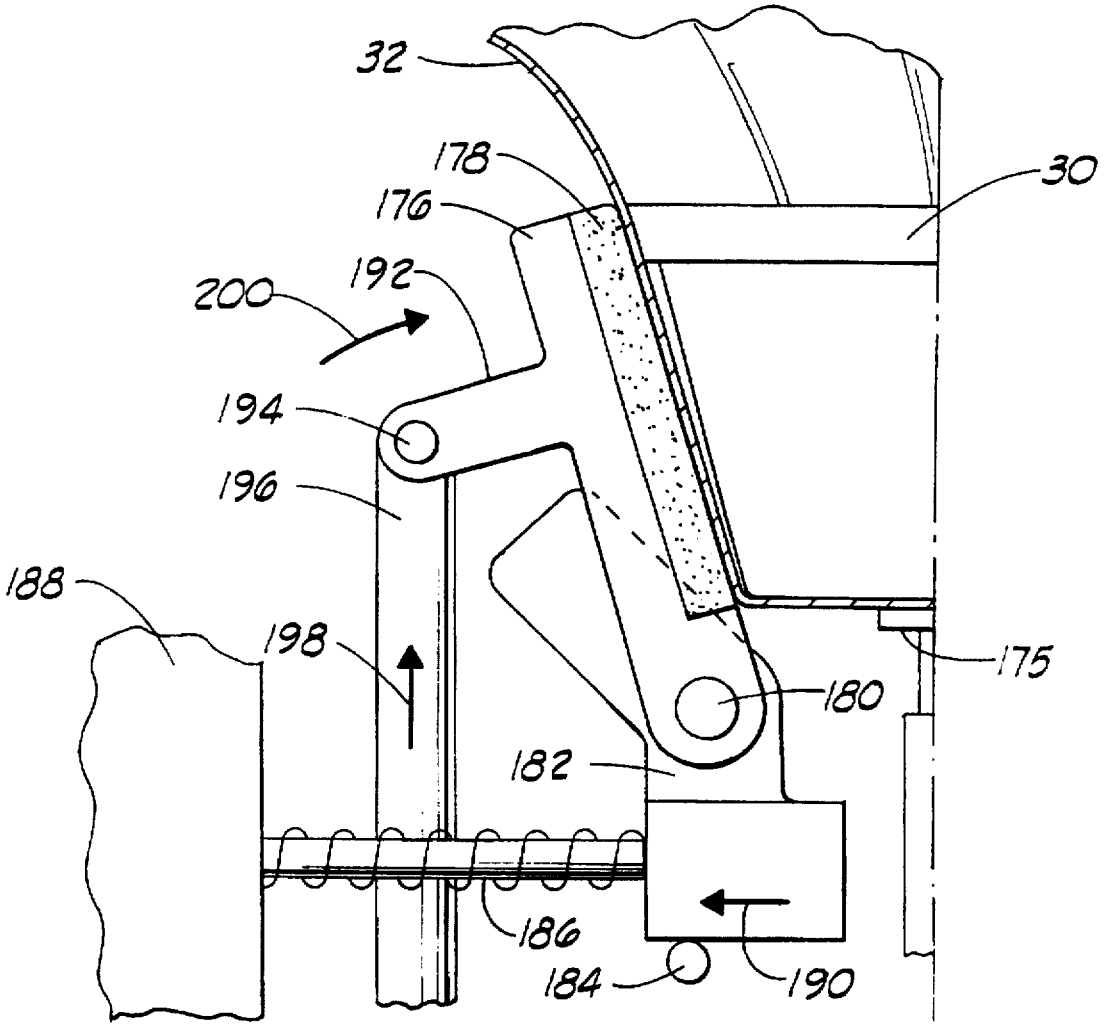
FIG. 12B is the embodiment of 12A with the forming member in the full extended position.

FIGS. 12A and 12B illustrate an embodiment in which a pot 30 and a sheet of material 32 are supported upon a support surface 175. A forming member 176 having a forming surface 178 is attached with a pivot attachment 180 to a pivoting head 182. A roller 184 supports and rollingly engages the pivoting head 182. The positioning rod 186 is attached to the one end to the pivoting head 182 and at the other end to a bracing structure 188 for the purpose of positioning the pivoting head 182 and moving it in a direction 190 to accommodate various sizes of pots 30. The forming member 176 has an extension arm 192 which is connected at a pivot point 194 to a connecting rod 196 for extending the forming member 176 into a forming position (FIG. 12B). When the connecting rod 196 is extended in a direction 198 as indicated in FIG. 12B the forming member 176 is extended in direction 200 for causing the forming member 176 to move into an extended forming position. Connecting rod 196 is connected to a connecting rod head (not shown) which is actuated by a driving means (not shown) which can be motor driven or manually driven, e.g. by a foot pedal.

Figure 13A:
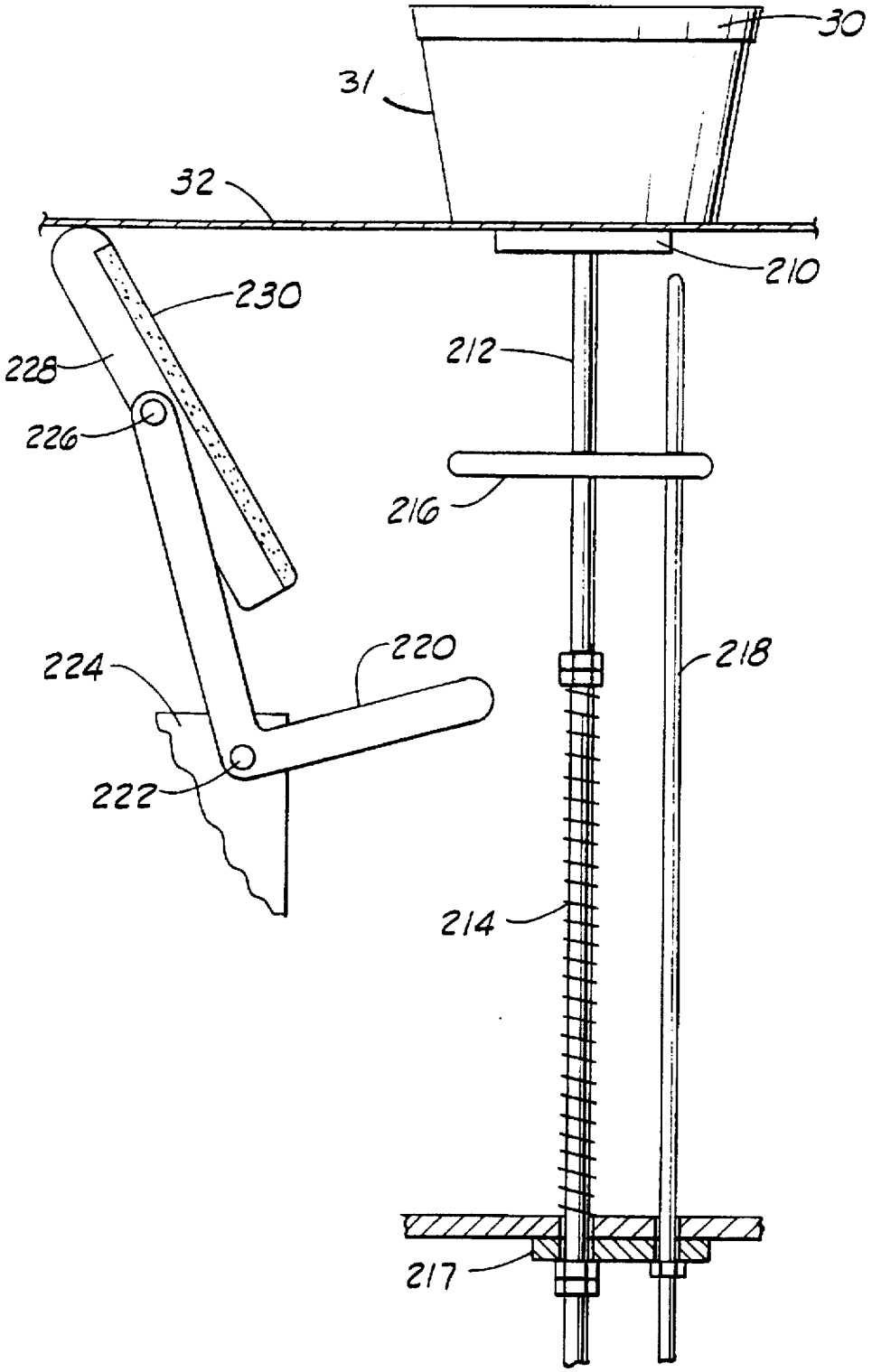
FIG. 13A is a side view of an alternative embodiment of a forming assembly showing a forming member in a storage position.
Figure 13B:
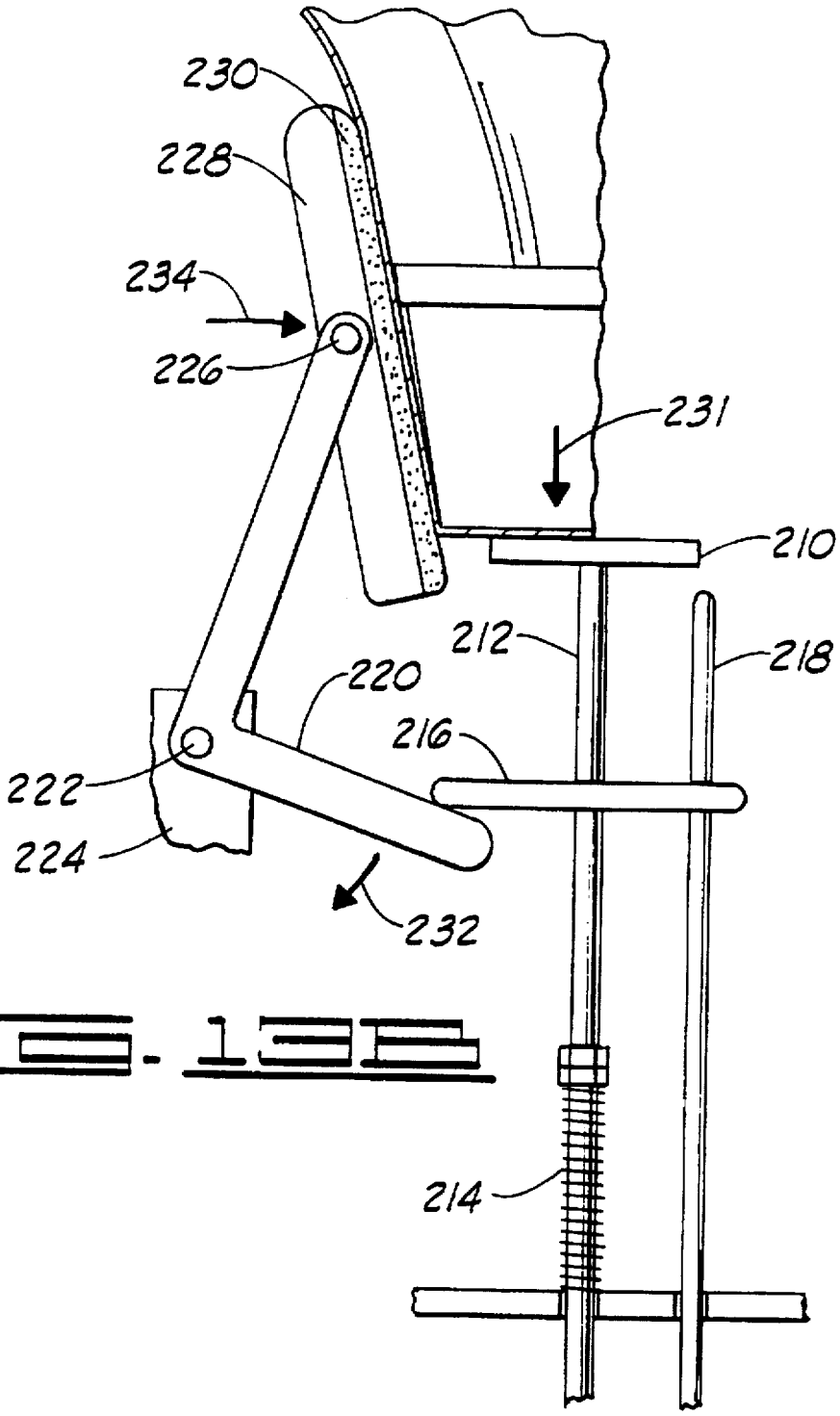
FIG. 13B is a side view of the embodiment of FIG. 13A in the fully extended position.

An alternative embodiment is illustrated in FIG. 13*a* and 13*b*. A pot 30 and a sheet of material 32 are supported on a support surface 210. The support surface 210 is supported by a support rod 212 having an extension spring 214 for biasing the support rod 212 in an extended position (FIG. 13A). Support rod 212 has a stop plate 217 for stopping the upward motion of the rod 212. A strike plate 216 is attached to the support rod 212 for the purpose of striking against a pivot armature 220 of a forming member 228. A secondary support rod 218 serves to maintain alignment of the strike plate 216. The pivot armature 220 has a pivot connection 222 for pivotally connecting to a bracing structure 224. The other end of the pivot armature 220 has a second pivot connection 226 for pivotally connecting to the forming member 228. The forming member 228 has a forming surface 230. When the pot 30 is drawn or pushed downward in direction 231 (FIG. 13B) the support rod 212 is disposed in a downward direction 231 wherein the strike plate 216 engages pivot armature 220 and pushes the pivot armature 220 downward in a direction 232. Forming member 228 is thereby moved in direction 234, wherein the forming surface 230 of the forming member 228 forces the sheet of material 32 against the outer surface of the pot 30 as indicated in FIG. 13B.

Figure 14A:
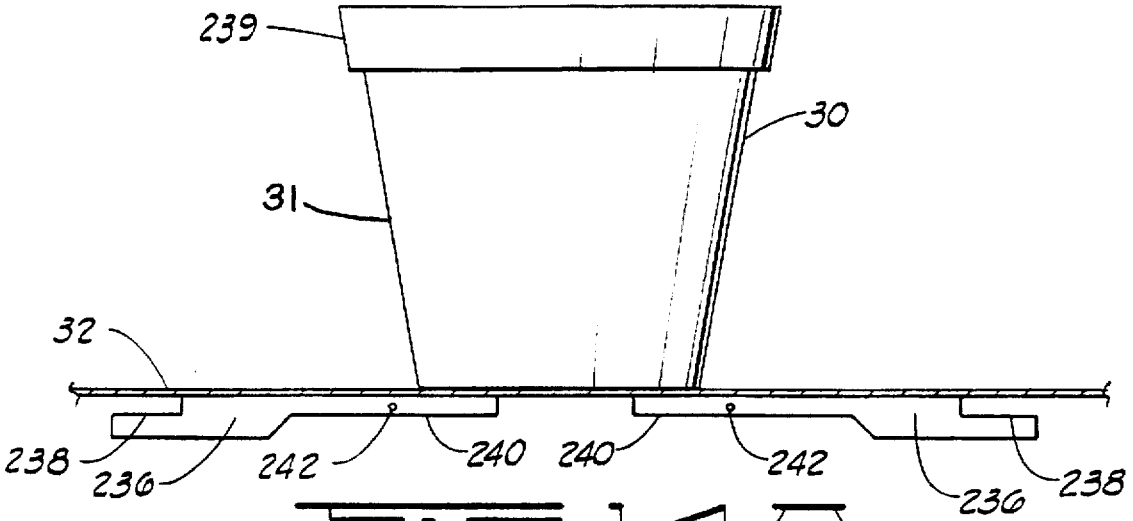
FIG. 14A is further alternative embodiment of a forming member assembly showing forming members in a storage position.
Figure 14B:
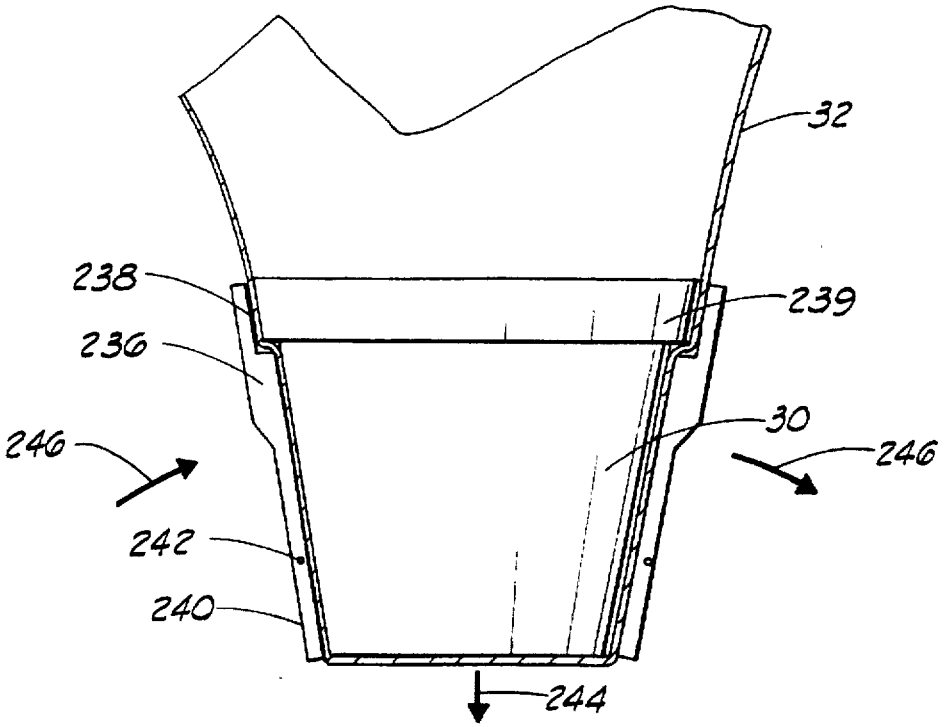
FIG. 14B is a side view of ,the alternative embodiment of FIG. 14A wherein the forming members are in the fully extended position.

A further embodiment is shown in FIGS. 14A and 14B. The pot 30 having a rim 239 is supported by a support end 240 of a forming member of 236. Forming member 236 has a recessed portion 238 adapted to receive the rim 239 of the pot 30. The forming member 236 is typically attached at pivot connection 242 to a forming member support head (not shown). As indicated in FIG. 14B when the pot 30 is pushed in a downward direction 244 the forming members 236 are caused to move in a direction 246 toward the pot wherein the sheet 32 is appressed by the forming members 236 against the pot. When the pot 30 is released, the forming members 236 are carried by gravity into the original storage position indicated in FIG. 14A.

It will be understood that the forming surfaces 132, 152, 178, 230, and the forming surface of 236 will, as indicated, for embodiments be comprised variously of such materials as foam or other soft or pliable plastic or other soft materials. Additionally the forming members 14, 130, 150, 176, 228 and 236 may be variously modified with heating elements, airblast jets, and sonic means, for the purpose of causing formation of the sheet of material to adhere or cohere to form a pot cover 34.

Figure 15A:
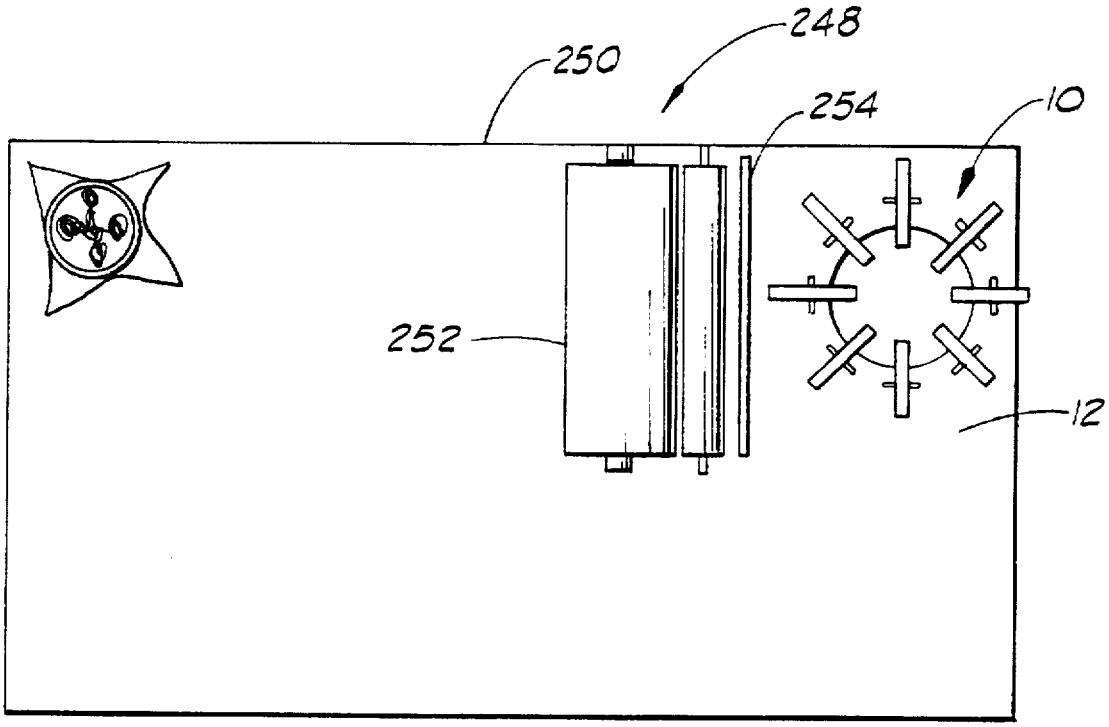
FIG. 15A is a top plan view of a mobile cover forming apparatus.
Figure 15B:
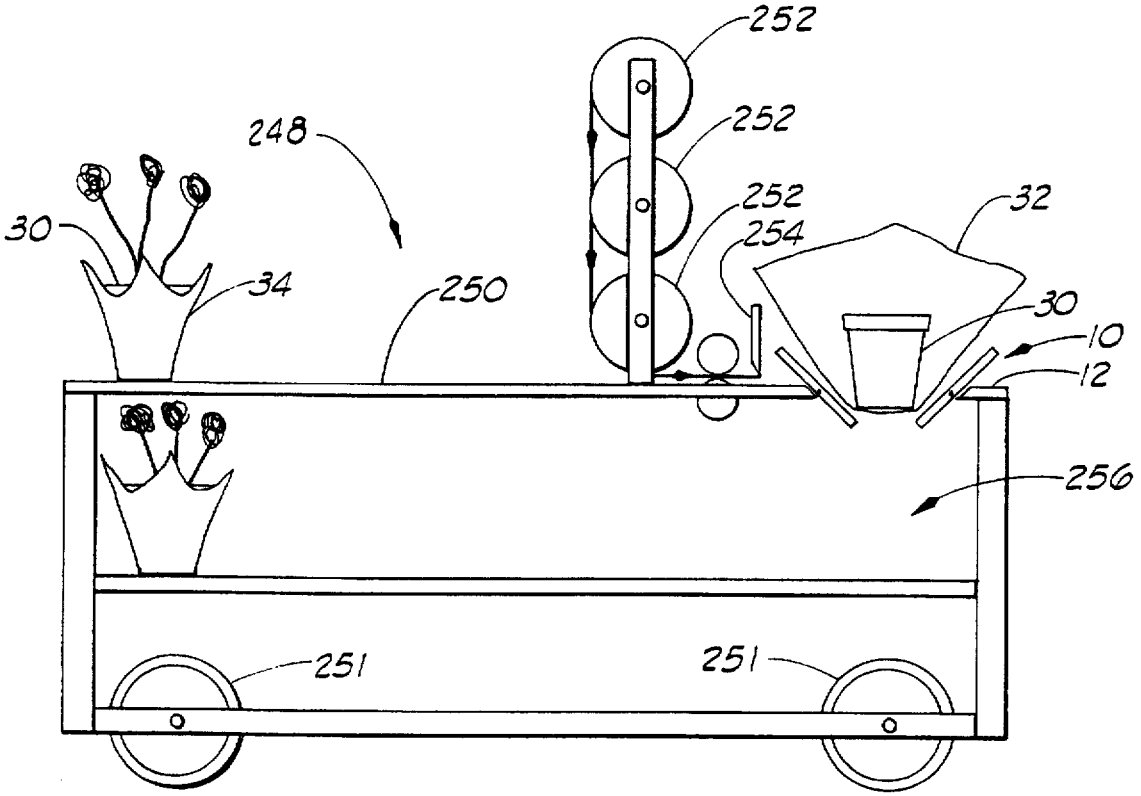
FIG. 15B is a side view of the mobile cover forming apparatus of FIG. 15A.

In an alternative embodiment, the cover forming apparatus 10 installed on a mobile cover forming apparatus 248 which is a portable platform 250 used for wrapping, storing, and transporting covered pots as shown in FIGS. 15A and 15B and having wheels 251 or other means for enabling the mobile platform to be moved from one location to another. The cover forming apparatus 10 of the mobile cover forming apparatus 248 can comprise all forming member embodiments described herein including the forming members described in FIGS. 1, 1A, and 5–14B. The mobile apparatus 248 may be equipped with rolls of material 252 which can be fed to the support surface 12 of the forming apparatus 10 or sheets of material 32 may be fed individually as loose sheets (not shown) or pads of sheets (not shown). Sheets could be fed individually or more than one sheet could be placed on the support surface 12 for forming a cover having multiple layers (not shown). If the sheet 32 was fed from a continuous roll 252 the individual sheets 32 could be separated from the roll 252 using an air knife 254 or guillotine or by serrations formed in the roll of material 252. This mobile cover forming apparatus 248 could be moved to a given location in a greenhouse where a single pot 30 would be removed from a table, wrapped and stored in a storage area 256 on the cart wherein the cart mobile apparatus 248 could then be moved to another location in the greenhouse if so desired.

Changes may be made in the various elements, components, parts and assemblies described herein or in the steps or sequences of steps in the methods described herein without departing from the spirit and scope of the invention as defined in the following claims.

What is claimed is:

1. A method for forming a cover about at least a portion of an outer peripheral surface of a flower pot, comprising the steps of:

providing a mobile cover forming apparatus, wherein the mobile cover forming apparatus comprises:

a mobile platform;

means for selectively moving the mobile platform from one location to another;

a sheet dispenser;

means for supporting the sheet dispenser and the flower pot;

a plurality of adjustable pivotable forming members radially arranged around a common center location at which the flower pot is supported, wherein each pivotable forming member has a pivot point relative to said common center location and each forming member has a forming surface, and means for pivoting the pivotable forming members, wherein the pivoting means is pivotally attached to the forming members for pivotingly urging the pivotable forming members to a forming member forming position, whereby the pivoting means is connected to the support means;

providing a sheet of material having an upper surface and a lower surface, wherein the sheet of material is operably engaged with the sheet dispenser;

moving the mobile cover forming apparatus to a predetermined location for covering the flower pot;

moving the pivotable forming members so as to engage the sheet of material and thereby form the sheet of material into a cover extending about at least a portion of the outer peripheral surface of the flower pot; and moving the mobile cover forming apparatus to a subsequent predetermined location.

2. The method of claim 1, wherein in the step of providing a mobile cover forming apparatus, the pivotable forming members further comprise means for operably engaging a means for securing the cover about at least a portion of the outer peripheral surface of the flower pot.

3. The method of claim 2, wherein in the step of providing a mobile cover forming apparatus, the engaging means further comprises a pivotable forming member having a plurality of barb-receiving apertures therein capable of engaging a plurality of barbs operably positioned on the outer peripheral surface of the flower pot.

4. The method of claim 2, wherein in the step of providing a mobile cover forming apparatus, the engaging means further comprises an effective amount of a substantially flexible material operably associated with the forming surface, wherein the effective amount of the substantially flexible material is capable of fastening the sheet of material to the outer peripheral surface of the flower pot.

5. The method of claim 2, wherein in the step of providing a mobile cover forming apparatus, the engaging means further comprises at least one male friction pinch element on the forming member forming surface capable of engaging with at least one female friction pinch element disposed on the outer peripheral surface of the flower pot, thereby causing the at least one male friction pinch element to insert a portion of the sheet of material into the at least one female friction pinch element thereby fastening the sheet of material to the outer peripheral surface of the flower pot.

6. The method of claim 1, wherein in the step of providing a sheet of material having an upper and a lower surface, the sheet of material further comprises an effective amount of an adhesive operably positioned on at least a portion of the upper surface of the sheet of material, whereby the effective amount of the adhesive is capable of adhering to the outer peripheral surface of the flower pot, thereby causing the sheet of material to be substantially fastened to the outer peripheral surface of the flower pot.

7. The method of claim 1, wherein in the step of providing a sheet of material having an upper surface and a lower surface, the sheet of material further comprises an effective amount of a cohesive on the upper surface of the sheet of material and a second effective amount of the cohesive on the outer peripheral surface of the flower pot, wherein the first and second effective amounts of the cohesive are capable of adhering to one another, whereby a portion of the sheet of material is fastened to the outer peripheral surface of the flower pot.

8. The method of claim 1, wherein in the step of providing a mobile cover forming apparatus, the pivotable forming members further comprise means for sonically sealing portions of the sheet of material to the outer peripheral surface of the flower pot.

9. The method of claim 1, wherein in the step of providing a mobile cover forming apparatus, the pivotable forming members further comprise means for vibratingly sealing portions of the sheet of material to the outer peripheral surface of the flower pot.

10. The method of claim 1, wherein in the step of providing a mobile cover forming apparatus, the pivotable forming members further comprise means for heat sealing portions of the sheet of material.

11. A method for forming a cover about at least a portion of an outer peripheral surface of a flower pot, comprising the steps of:

providing a mobile cover forming apparatus, wherein the mobile cover forming apparatus comprises:

a mobile platform;

means for selectively moving the mobile platform from one location to another;

a sheet dispenser;

means for supporting the sheet dispenser and the flower pot;

a storage shelf operably positioned within the mobile platform;

a plurality of adjustable pivotable forming members radially arranged around a common center location at which the flower pot is supported, wherein each pivotable forming member has a pivot point relative to said common center location and each forming member has a forming surface; and means for pivoting the pivotable forming members, wherein the pivoting means is pivotally attached to the forming members for pivotingly urging the pivotable forming members to a forming member forming position, whereby the pivoting means is connected to the support means;

providing a sheet of material having an upper surface and a lower surface, wherein the sheet of material is operably engaged with the sheet dispenser;

moving the mobile cover forming apparatus to a predetermined location for covering the flower pot;

moving the pivotable forming members so as to engage the sheet of material and thereby form the sheet of material into a cover extending about a portion of the outer peripheral surface of the flower pot;

disposing the flower pot having the sheet of material formed thereto onto the storage shelf positioned within the mobile platform; and moving the mobile cover forming apparatus to a subsequent predetermined location.

12. The method of claim 11, wherein in the step of providing a mobile cover forming apparatus, the selective moving means comprises a plurality of rollers attached to the mobile cover forming apparatus.

13. The method of claim 11, wherein in the step of providing a mobile cover forming apparatus, the flower pot and the sheet dispenser support means comprises a substantially linear surface attached to the mobile cover forming apparatus.

14. The method of claim 11, wherein in the step of providing a mobile cover forming apparatus, the sheet dispenser comprises a plurality of stacked sheets of material.

15. The method of claim 11, wherein in the step of providing a mobile cover forming apparatus, the sheet dispenser comprises a continuous roll of material.

16. The method of claim 15, wherein in the step of providing a mobile cover forming apparatus, the sheet dispenser further comprises a continuous roll of material having spaced apart means for detaching a single sheet of material having a predetermined length.

17. The method of claim 15, wherein in the step of providing a mobile cover forming apparatus, the sheet dispenser comprises a continuous roll of material, and wherein the mobile cover forming apparatus further comprises means for detaching a single sheet of material having a predetermined length.

18. The method of claim 11, wherein in the step of providing a mobile cover forming apparatus, the mobile cover forming apparatus further comprises a plurality of storage shelves positioned within the mobile platform.

* * * * *

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

In the Drawings:

FIG. 3, please add the reference numeral --14-- and its associated lead line (see Col. 4, lines 12-16).

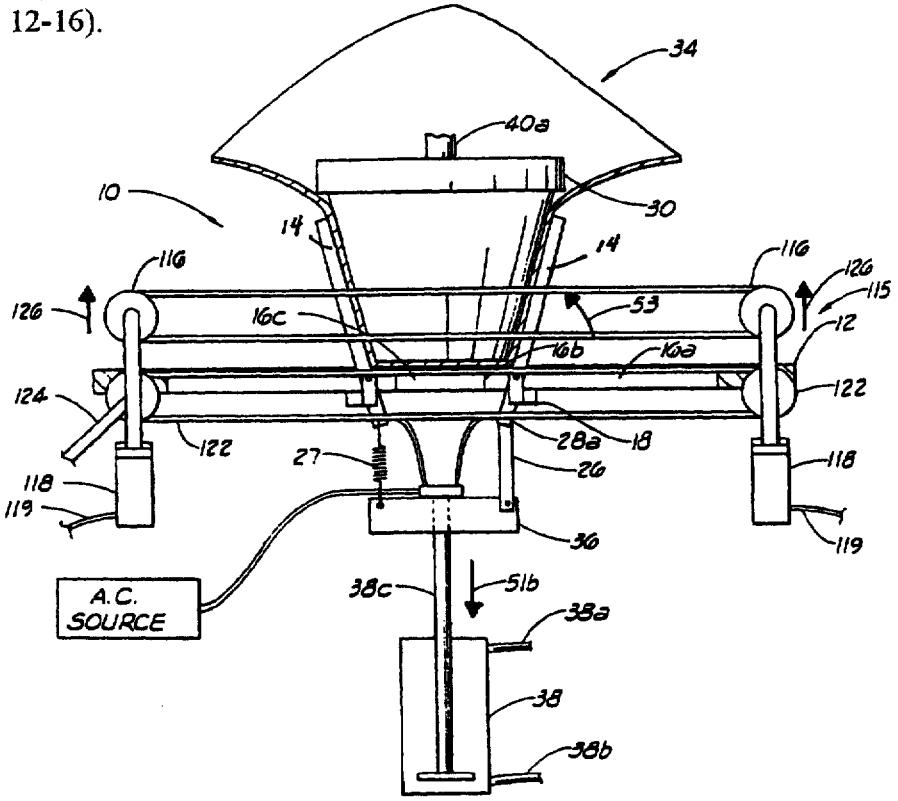

FIG. 3

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

FIG. 4, please add an arrowhead designation to the lead line for reference numeral "71"; please add the reference numeral --81-- and its associated lead line; and please add reference numeral --115-- and its associated lead line.

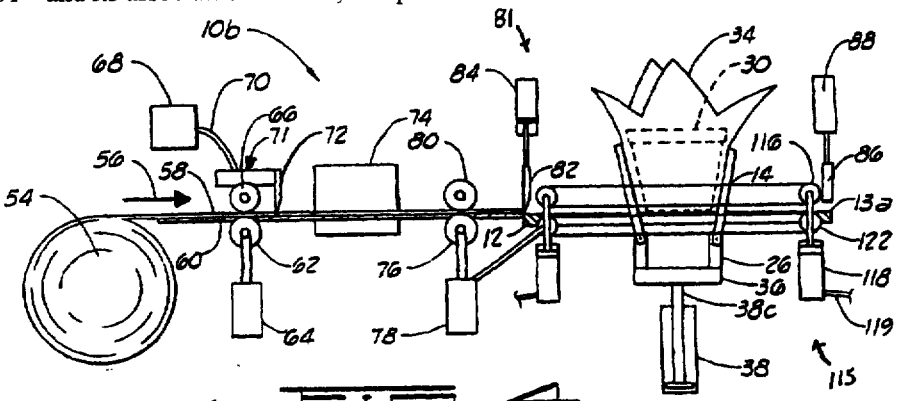

FIG. 4

FIG. 6, please add the reference numerals --31-- and --32a-- and each associated lead line.

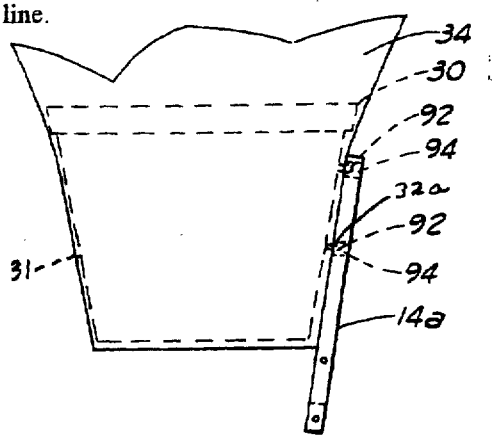

FIG. 6

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

Figure 10B:
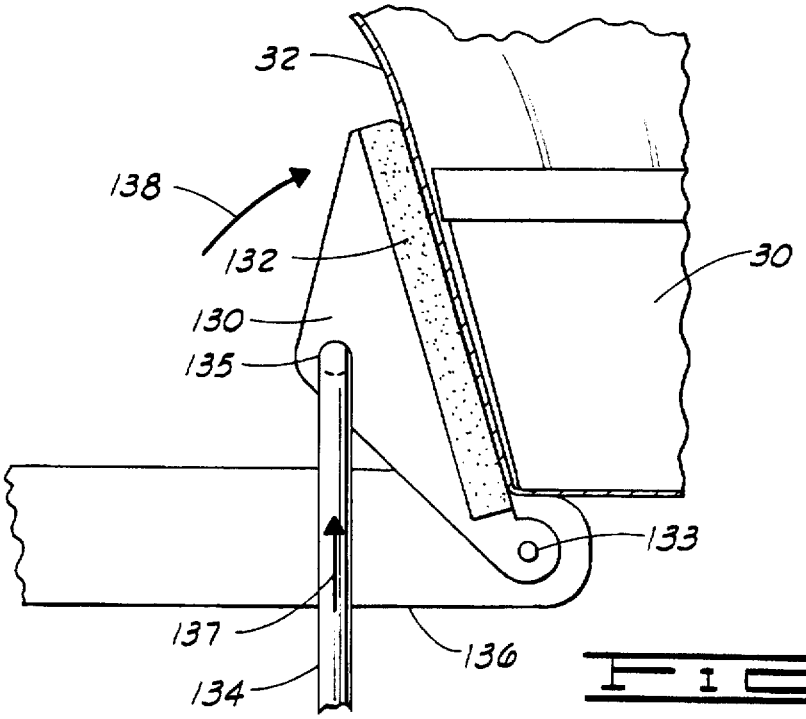
FIG. 10B is a side view of the embodiment in FIG. 10A in an extended position.

It is certified that error appears in the above-identified patent and that said Letters Patent is hereby corrected as shown below:

FIG. 10B, please delete the reference numeral "138" and substitute --140-- therefor

FIG. 10B

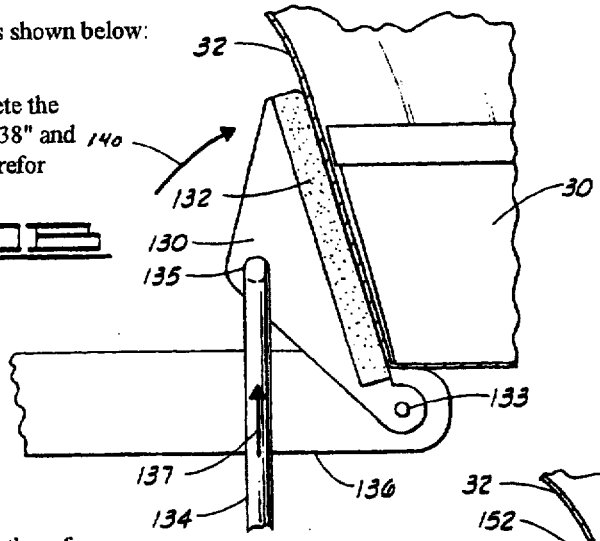

FIG. 11B, please add the reference numeral --164-- and its associated lead line.

FIG. 11B

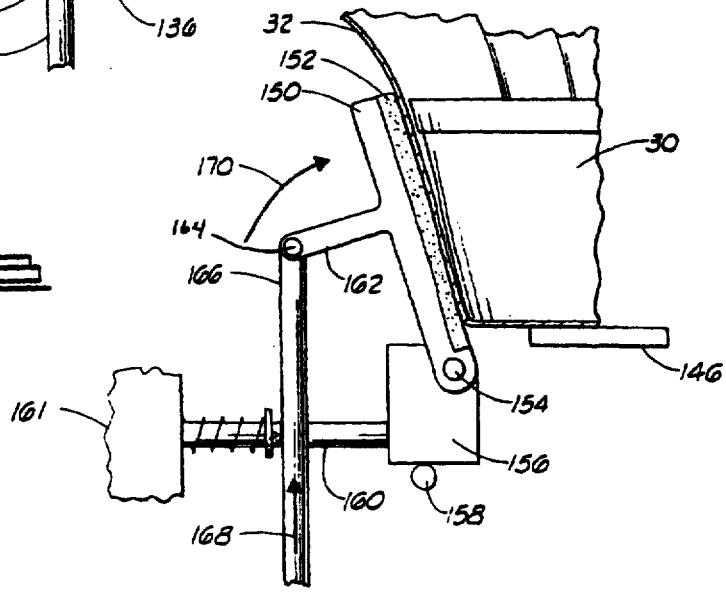

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

FIG. 13B, please add the reference numerals --10-- and --32--.

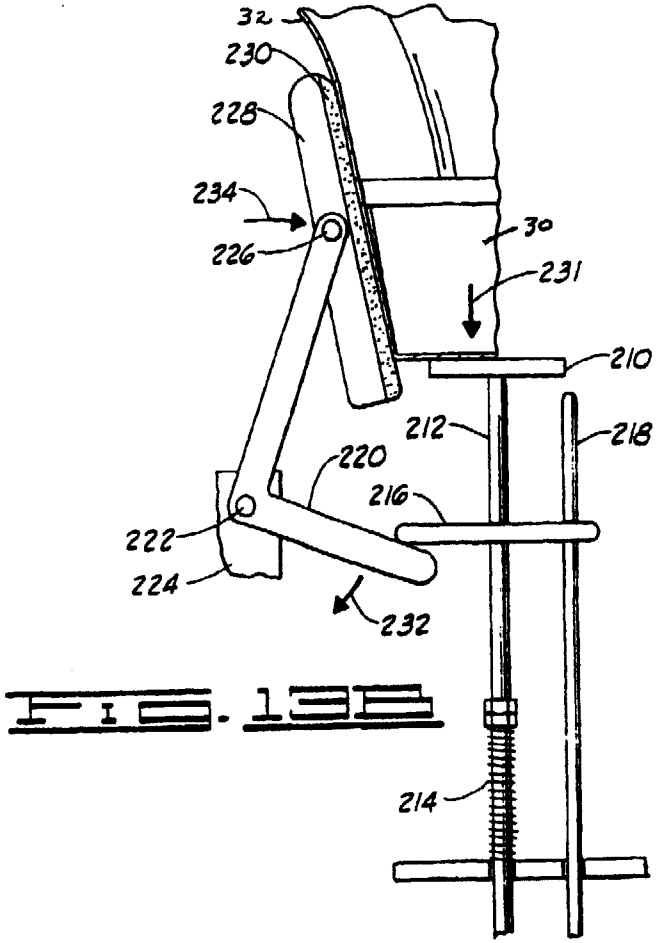

FIG. 13B

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

FIG. 14B, please add the reference numerals --236--, --238--, and --242--; please reverse the arrow designated by the numeral "246".

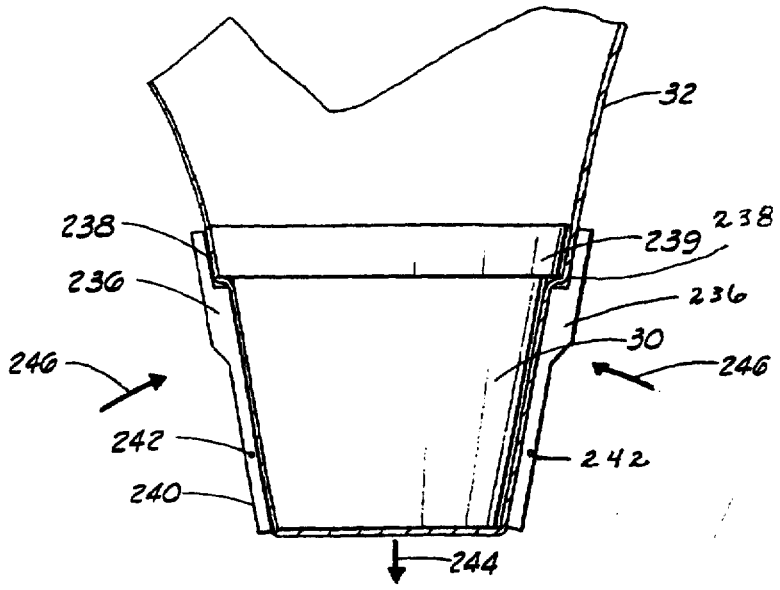

FIG. 14B

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

In the Description:

Col. 1: line 49, delete "elevation," and substitute therefor --elevational--;

Col. 2: line 9, delete "partial" and substitute --partially-- therefor;

line 11, delete "full" and substitute - -fully-- therefor;

line 39, delete "article" and substitute --pot or cover-- therefor;

line 40, delete "the sheet" and substitute --a sheet-- therefor;

line 41, delete "the forming" and substitute --a forming die,-- therefor;

line 42, delete "members." and substitute --members 14.-- therefor;

line 44, delete "the female" and substitute --a female-- therefor;

lines 48-49, delete "pot or die" and substitute --forming die, mold or pot 30-- therefor;

line 49, after "material" and before "but" insert --32- -;

line 50, after "material" and before "as" insert --32--;

line 50, after "sheet" and before "is" insert --of material 12- -;

line 51, delete "pot or die" and substitute --forming die, mold or pot 30--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 2 (continued)

line 52, delete "members." and substitute --members 14.-- therefor;

line 57, delete "apparatus," and substitute --apparatus 10,-- therefor;

line 57, after "pot" and before "can" insert --30--;

line 60, after "members" and before "of" insert --14--;

line 61, after "pot" and before "cover" insert --or--;

line 67, after "members" and before "of" insert --14--;

Col. 3: line 3, after "apparatus" and before "can" insert --10--;

line 4, after "apparatus" and before "from" insert --10--;

line 11, after "a" and before "die," insert --forming--;

line 15, delete "side" and substitute --surface-- therefor;

line 24, after "around" and before "opening" insert --central-- (see application, p. 5, line 23);

line 24, after "the" and before "mold" insert --forming die,--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 3 (continued)

line 33, after "the" and before "apparatus" insert --forming--;

line 38, delete "member" and substitute --mount -- therefor;

line 46, before "cross arm" insert --pivot assembly--;

line 46, after "to" and before "slots" insert --pivot assembly--;

line 49, before "cross" insert - -pivot assembly–;

line 50, after "The" and before "cross" insert --pivot assembly--;

line 53, after "along" and before "slots" insert --pivot assembly- -;

lines 58-59, delete "die, mold or pot objects" and substitute therefor --forming dies, molds or pots 30--;

line 67, delete "element" and substitute --cylinder-- therefor;

Col. 4: line 2, after "cylinder" and before "is" insert --38--;

line 13, delete "pot or mold" and substitute --forming die, mold or pot-- therefor;

line 21, after "the" and before "mold" insert --forming die,--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 4 (continued)

line 23, delete "pot or mold 30." and substitute --forming die, mold or pot 30 (see Fig. 5).- - therefor line 26, after "the" and before "mold" insert --forming die,--;

line 29, delete "the" and substitute --a-- therefor;

line 38, after "sheet" and before "32." insert - -of material--;

line 40, after "sheet" and before "32" insert - -of material--;

line 41, after "sheet" (both occurrences) and before "32" (both occurrences) insert --of material--;

line 43, after "sheet" and before "32" insert - -of material--;

line 47, delete "cover shape" and substitute --shaped cover-- therefor;

line 54, after "the" and before "cover" insert - -pot or--;

line 59, delete "flower pot object" and substitute --pot or cover-- therefor;

line 64, delete "pot or mold" and substitute --forming die, mold or pot- - therefor;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 5: line 3, delete "pot or mold" and substitute --forming die, mold or pot-- therefor;

line 4, delete "pot or mold" and substitute --forming die, mold or pot-- therefor;

line 6, delete "die" and substitute --die, mold-- therefor;

line 9, after "members" and before "having" insert --14--;

line 11, delete "pot or mold" and substitute --forming die, mold or pot-- therefor;

line 17, delete "pot or mold" and substitute --forming die, mold or pot-- therefor;

line 18, delete "pot or mold" and substitute --forming die, mold or pot-- therefor;

line 20, after "the" and before "mold" insert --forming die,";

line 26, delete "pot or mold" and substitute --forming die, mold or pot-- therefor;

line 34, after "to" and before "outer" insert --the--;

line 34, delete "the pot" and substitute --a pot-- therefor;

line 36, delete "the pot" and substitute --a pot-- therefor;

line 37, after "sheet" (both occurrences) and before "32" (both occurrences) insert --of material--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 5 (continued)

line 43, delete "connecting";

line 46, delete "the pot" and substitute --a pot-- therefor;

line 47, delete "portion" and substitute --portions-- therefor;

line 48, after "pot" and before "by" insert --30--;

line 51, delete "flower";

line 53, delete "pot 34" and substitute --pot 30-- therefor;

line 58, delete "the forming" and substitute --a-- therefor;

line 60, delete "oppressed" and substitute therefor --appressed-- therefor;

line 62, delete "flower";

line 65, delete "flower";

line 67, delete "the forming" and substitute --a-- therefor;

Col. 6: line 3, delete "flower pot 32" and substitute --pot 30-- therefor;

line 12, delete "that" and substitute --That-- therefor;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 6 (continued)

line 13, after "object," and before "will" insert --it--;

line 30, delete "flower";

line 32, delete "flower";

line 33, delete "flower";

line 35, delete "flower", and after "sheet" and before "engages" insert - -of material 32--;

line 37, after "the" and before "material" insert --sheet of";

line 39, delete "flower";

line 41, after "surface" and before "of" insert --31--;

line 56, delete "material" and substitute --sheet of material 32-- therefor;

line 60, delete "of" and substitute therefor --about--;

Col. 7: line 3, after "the" and before "material" insert --sheet of--;

line 6, delete "engaging" and substitute "engage" therefor;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 7 (continued)

line 7, delete "surface" and substitute --outer surfaces-- therefore;

line 13, delete "on" and substitute --in-- therefor;

line 20, delete "on" and substitute therefor --in--;

line 24, delete "material" and insert --portion-- therefor;

line 25, delete "flower";

line 38, delete "flower";

line 40, delete "mold" and substitute --forming die, mold or pot-- therefor;

line 44, delete "the mold" and substitute --a mold-- therefor;

line 44, delete "forming" and substitute --upper-- therefor;

line 46, delete "forming apparatus" and substitute therefor --support--;

line 47, after "a" and before "die" insert --forming--;

line 49, after "The" and before "die" insert --forming--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 7 (continued)

line 51, after "the" and before "cylinder" insert --hydraulic--;

line 52, after "the" and before "cylinder" insert --hydraulic--;

line 54, after "the" and before "die" insert --forming--;

line 54, delete "position" and substitute --direction-- therefor;

line 55, after "the" and before "die" insert --forming--;

line 56, delete "upward position" and substitute therefor --upward direction--;

line 60, after "the" and before "beam" insert --pivoting--;

line 61, after "the" and before "die" insert --forming--;

line 64, after "the" and before "mold" insert --forming die or--;

line 66, after "the" and before "die" insert --forming--;

Col. 8: line 1, delete "side" and substitute therefor --surface--;

line 2, after "the" and before "die" insert --forming--;

line 3, after "the" and before "die" insert --forming--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 8 (continued)

line 5, after "the" and before "die" insert --forming--;

line 6, delete "cylinder" and substitute --piston or-- therefor;

line 6, delete "position" and substitute --direction-- therefor;

line 7, after "the" and before "die" insert --forming--;

line 11, delete "side" and substitute --surface-- therefor;

line 13, after "The" and before "die" insert --forming--;

line 13, after "the" and before "cylinder" insert --hydraulic--;

line 14, delete "its" and substitute --their-- therefor;;

line 15, delete "an offset" and substitute --a storage-- therefor;

line 17, after "to" and before "beam" insert --pivoting--;

line 18, after "the" and before "cylinder" insert --hydraulic--;

line 20, delete "hydraulic cylinder" and substitute therefor --secondary hydraulic cylinder 46--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 8 (continued)

line 22, after "the" and before "hydraulic" insert --secondary--;

line 23, after "2," and before "cylinder" insert --secondary hydraulic--;

line 24, after "primary" and before "cylinder" insert --hydraulic--;

line 25, after "in" and before "cylinder" insert --secondary hydraulic--;

line 26, after "the" and before "beam" insert --pivoting--;

line 27, after "whereby" and before "beam" insert --pivoting--;

line 27, after "carries" and before "cylinder" insert --hydraulic--;

line 28, after "and" and before "mold" insert --forming die or--;

line 28, after "the" and before "cylinder" insert --hydraulic--;

line 29, after "and" and before "mold" insert --forming die or--;

line 32, after "the" and before "mold" insert --forming die or--;

line 46, delete "film" and substitute --material-- therefor;

line 47, delete "surface" and substitute --extension-- therefor;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 8 (continued)

line 47, delete "material" and substitute --sheet-- therefor;

line 48, after "roll" and before "54" insert --of material--;

line 52, delete "of material";

line 55, delete "of material";

line 56, delete "surface" and substitute --extension-- therefor;

line 57, after "on" and before "surface" insert --support--;

line 59, delete "84" and substitute --81-- therefor;

line 60, delete "and 82";

line 64, delete "material" and substitute --sheet-- therefor;

line 65, after "roll" and before "54" insert --of material--;

line 66, delete "surface" and substitute --extension-- therefor;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 9: line 7, delete "of material";

lines 7-8, delete "of material";

line 9, after "assembly" and before "comprises" insert --115--;

line 13, after "126" and before "whereby" insert --(Fig. 3)--;

line 13, delete "of material";

line 18, delete "of material";

line 21, delete "system" and substitute --forming apparatus-- therefor;

lines 22-23, delete "of material";

line 23, after 'conveyor" and before "assembly" insert --belt--;

line 24, delete "material" and substitute --sheet-- therefor;

line 26, delete "material" and substitute --sheet-- therefor;

line 26, after "the" and before "support" insert --upper surface 13 of the--;

line 28, after "conveyor" and before "assembly" insert --belt--;

line 30, delete "of material";

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 9 (continued)

line 30, delete "surfaces 58 or" and substitute therefor --support surface--;

line 30, after "of" and before "apparatus" insert --forming--;

line 31, delete "cylinder 84" and substitute --81-- therefor;

line 32, delete "blade" and substitute --knife-- therefor;

line 33, delete "58" and substitute --54-- therefor;

line 35, after "apparatus" and before "**10*b***" delete "of";

line 38, delete "blade" and substitute --knife-- therefor;

line 43, after "on" and before "surface" insert --support--;

line 44, delete "over" and substitute --of-- therefor;

line 44, after "apparatus" and before "**10*b*.**" delete "of";

line 49, after "the" and before "roller" insert --applicator--;

line 50, after "the" and before "roller" insert --applicator--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 9 (continued)

line 55, delete "of system";

line 67, delete "comprised" and substitute therefor --comprised,--;

Col. 10: line 9, delete "138" and substitute --140-- therefor;

line 9, after "sheet" and before "32" insert --of material--;

line 38, delete "The" and substitute therefor --A--;

line 39, delete "to the" and substitute --at-- therefor;

line 54, delete "FIG." and substitute therefor --FIGS.--;

Col. 11: line 13, after "member" and before "236." delete "of";

line 19, after "pot" and before "wherein" insert --30--;

line 21, delete "pot." and substitute --pot 30.-- therefor;

line 25, after "of" and before "236" insert --forming member--;

line 26, delete "for embodiments";

line 31, after "material" and before "to" insert --32--;

UNITED STATES PATENT AND TRADEMARK OFFICE

CERTIFICATE OF CORRECTION

PATENT NO. : 5,699,647

DATED : December 23, 1997

INVENTOR(S) : Donald E. WEDER et al.

It is certified that error appears in the above-identified patent and that said Letters Patent is hereby corrected as shown below:

Col. 11 (continued)

line 34, after "10" and before "installed" insert --can be--;

line 50, after "roll" and before "252" insert --of material--;

line 51, after "roll" and before "252" insert --of material--; and line 56, delete "cart mobile apparatus" and substitute therefor --mobile cover forming apparatus--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*